United States Patent [19]

Underwood

[11] 4,073,352

[45] Feb. 14, 1978

[54] RAISE BORE DRILLING MACHINE

[75] Inventor: Gene E. Underwood, Casper, Wyo.

[73] Assignee: Occidental Oil Shale, Inc., Grand Junction, Colo.

[21] Appl. No.: 663,546

[22] Filed: Mar. 3, 1976

[51] Int. Cl.[2] ..... E21C 23/00

[52] U.S. Cl. ..... 175/53; 64/23.6; 173/165; 175/195; 175/320

[58] Field of Search ..... 175/53, 320, 195; 173/163, 164, 165; 64/23.5, 23.6, 23.7; 248/62

[56] References Cited

U.S. PATENT DOCUMENTS

| | | | |
|---|---|---|---|
| 1,141,927 | 6/1915 | Boyd et al. | 64/23.7 X |
| 1,259,852 | 3/1918 | Greve | 64/23.5 |
| 2,207,199 | 7/1940 | Hild | 175/195 |
| 2,346,958 | 4/1944 | Abegg | 64/23.7 |
| 2,586,784 | 2/1952 | Capp et al. | 64/23.5 |
| 2,904,311 | 9/1959 | Spiri | 64/23.7 |
| 3,463,247 | 8/1959 | Klein | 173/164 |
| 3,598,189 | 8/1971 | Presley et al. | 175/53 |

*Primary Examiner*—Ernest R. Purser
*Assistant Examiner*—Richard E. Favreau
*Attorney, Agent, or Firm*—Christie, Parker & Hale

[57] ABSTRACT

A raise bore drilling rig is provided for use with a drill string of non-round cross-sectional configuration; the drill string is connectible through a pilot hole from a raise bore bit at the lower end of the pilot hole to the raise bore drilling rig at the upper end of the hole. To enable simple assembly of the drill string, the upper end of each length of drill string is circular in way of the female component of a threaded coupling. The drilling rig includes a rotary drive mechanism which mates with the non-round cross-section of individual lengths of drill string and which is rotatably driven to apply torque to the drill string as it is raised axially during the raise bore drilling process. The torque applying component of the drilling rig which is directly engageable with the drill string includes a vertically floating "bushing" which enables torque to be applied to the string as a coupling is raised through a normal "at rest" position of the bushing. While the coupling is being attached or disconnected, the drill string is temporarily held, at a location below the coupling, from falling back into the hole as the uppermost length of the string is removed from the string. The bushing is effectively expansible to enable the coupling to be passed therethrough.

77 Claims, 16 Drawing Figures

RAISE BORE DRILLING MACHINE

BACKGROUND OF THE INVENTION

1. Field of the Invention

This invention pertains to raise boring. More particularly, it pertains to an improved raise bore drill string, and to a novel bore drilling rig.

2. Review of the Prior Art and the Problems Thereof

Raise boring is commonly encountered in mining. A raise is a vertical shaft extending between different levels in a mine, or from a room or passage in a mine to the exterior of the mine, as for a ventilation shaft, for example. In boring a raise, a pilot hole is first drilled downwardly along the desired line from the top of the desired raise to the lower end thereof. Personnel at the bottom end of the pilot hole remove the pilot hole bit from the drill string (composed of serially connected lengths or "joints" of drill collars or heavy-wall drill pipe) and connect to the lower end of the drill string a raise bore bit. The raise bore bit is arranged to cut upwardly into the formation around the pilot hole as the drill string is simultaneously rotated and raised. The pilot hole bit may be arranged to form a hole of, say, 9⅞ inches diameter as it proceeds downwardly through the formation. The raise bore bit, on the other hand, may be arranged to cut a hole of, say, 48 inches diameter as it proceeds upwardly through the formation. Bits, procedures, and equipment for performing these operations are known for raises in excess of 12 feet in diameter.

A procedure has been developed to commercially develop underground oil shale deposits in situ. This procedure involves sophisticated mining techniques and one desirable embodiment involves the creation of large numbers of raises in the oil shale deposit as a preliminary to recovery of the shale oil from the deposit. In order that such an approach to scale oil recovery may be practiced economically, it is important that all mining-like operations preliminary to the actual recovery stage, including creation of the many necessary raises, be performed as efficiently and as economically as possible. It is at this point that the limitations of present raise boring techniques and equipment begin to present problems of efficiency, to which problems this invention is addressed.

It should be noted that while this invention and its positive economic impact are perhaps best illustrated in the context of in situ oil scale recovery operations, the invention has utility in all aspects of raise bore drilling wherever encountered.

The problems and limitations of existing raise boring procedures to which this invention is addressed center around the difficulties presented in removing from the drill string a length or lengths thereof, as is required from time to time, as the raise proceeds upwardly and the drill string emerges progressively from the upper end of the pilot hole. These difficulties are best illuminated by a comparison of conventional down-hole drilling procedures with up-hole (raise bore) drilling procedures.

Down-hole drilling procedures followed in forming the pilot hole may rely on either a power swivel or a rotary table to apply torque to a conventional drill string composed of lengths of hollow, round cross-sectional drill pipe serially connected by conventional coaxial threaded couplings. A power swivel is essentially a motor (electric, hydraulic or pneumatic) having a hollow shaft connected to the upper end of the drill string and through which a circulating fluid (air or drilling mud) is introduced into the drill string for flow out of the drill bit and back up the drilled hole to cool the bit and to clear the bit and the hole of cuttings generated by operation of the drill bit. The power swivel is suspended in a suitable derrick positioned over the hole. When the hole has progressed downwardly an amount equal to the length of a single piece of drill pipe (a single piece commonly being called a "joint") or by an amount equal to the length of a "stand" (a group of two or three preassembled joints), rotation of the drill string is discontinued. The drill string is then secured in the hole by inserting suitable wedging chocks (called "slips") into the hole around the string below the connection of the swivel to the string. The swivel is disconnected from the string, raised in the derrick, and a new joint or stand is connected between the string and the swivel. The slips are then released and drilling is resumed.

Where a rotary table is used in down-hole drilling, as is common in the oil and gas industry, the swivel is passive and serves principally as a means for introducing circulating fluid into the drill string as it is rotated by the rotary table. A non-round, usually hexagonal or square length of special pipe, called a "kelly", is connected between the swivel and the upper end of the drill string. The kelly is, in effect, a long spline which cooperates with rollers in a kelly bushing carried in the rotatably driven annular member of the rotary table which is located in the base of the derrick. The kelly bushing rollers cooperate with the hexagonal or square configuration of the kelly to apply torque to the kelly and to accommodate axial motion of the kelly as the hole proceeds downwardly. The kelly has a length greater than the longest joint or stand used to make up the drill string. When the hole has increased in depth by an amount about equal to the length of the kelly, the drill string is raised through the kelly bushing until the coupling between the kelly and the drill string is above the rotary table, and slips are inserted into the bushing to prevent the string from falling back into the hole. The kelly is unscrewed from the drill string, a new joint or stand is added to the upper end of the drill string, and the extended string is lowered back into the hole until the upper end thereof is just above the rotary table, at which point the slips are again applied to secure the drill string. The kelly is then reconnected to the upper end of the drill string as extended, the slips are removed, and the string is lowered back into the hole so that the kelly reengages the kelly bushing. Drilling is then resumed until it is necessary to add another joint or stand to the drill string.

During down-hole drilling, removal of a joint or stand is often necessary, as where the drill string must be removed from the hole to change drill bits. This is no problem because, whether a power swivel or a rotary table and kelly are used, the coupling between the drill string and the joint or stand thereof to be remoed is readily made accessible above the top of the hole merely by raising the drill string the required distance out of the hole. In raise boring, however, the large diameter upwardly-cutting raise bore bit prevents the drill string from being raised in the hole except as the bit itself cuts upwardly. This fact, coupled with the fact that raise boring can be done through a rotary table rather than by use of a power swivel, means that the drill string cannot be raised to expose the coupling between the kelly and the drill string above the rotary table. It is for this reason that removal of joints or stands from a drill string during raise boring is a difficult, often hazardous, and time consuming procedure.

The pilot hole for a raise bore is often drilled using a power swivel rig. This is satisfactory since the pilot hole is small in diameter and the drill bit is cutting downwardly so that the proper drill bit loads can be established by weights added to the drill string as needed. The power swivel is not required to carry large axial loads, only to generate torque at moderate levels compared to the levels of torque required to operate a raise bore bit. In raise boring, however, the drill string torque levels are very high due to the size of the raise bore bit, and the drill string is maintained under considerable tension to establish the proper axial load on the raise bit. Power swivels are not well suited to the generation of high levels of torque or to prolonged application of large axial loads, unless the power swivel is very large and heavy, and quite expensive. Rotary table drilling rigs, on the other hand, do not carry any axial loads during actual drilling (axial loads are carried by the travelling block in the rotary table rig) and can economically apply large torque loads to a drill string via a kelly. It is for these reasons that rotary table rigs, rather than power swivel rigs, are used during raise boring operations.

From the foregoing, it is seen that existing raise bore drilling techniques and equipment present problems in the area of removal from the drill string of joints or stands thereof no longer needed as the raise proceeds upwardly. A need exists for improved raise bore drilling techniques and equipment which overcome these problems.

SUMMARY OF THE INVENTION

This invention provides improved raise bore drilling procedures and apparatus which overcome the problems described above. The improved procedures and apparatus are simple, safe, effective and efficient. They make it possible to bore a raise more economically than previously by minimizing the time and hazards of removing no longer needed joints or stands from the drill string. If desired, the same equipment may be used to drill the raise pilot hole as to bore the raise itself.

In its broadest procedural terms, this invention pertains to a method of raise boring in which a drill string extends in a pilot hole between a raise bit at the lower end of the pilot hole and a drill string drive means above and adjacent the upper end of the pilot hole. The drill string drive means includes means operable for applying torque and axial tension to the drill string while affording axial motion of the drill string. The present improvement comprises using a drill string, for transmitting torque and axial tension from the drive means to the raise bit, which is of non-round transverse configuration except periodically along the drill string at locations associated with the connections between adjacent drill pipe lengths which are serially connected to define the drill string.

This invention also provides an improved raise bore drilling rig which is useful with a drill string composed of a plurality of individual drill pipe lengths of non-round transverse external cross-section. The rig comprises a rotary table having a drivable annular member which is rotatable about a central vertical axis and through which the drill string can be raised during raise boring. Torque transmitting means are mounted to the annular member for rotation therewith. The torque transmitting means include contacting means configured to mate with the non-round portion of the drill string for transmitting torque from the member to the drill while accommodating axial movement of the drill string. The contacting means have a base position defined vertically relative to the annular member. The torque transmitting means is arranged for accommodating upward movement through the base position of the contacting means of a connection in the drill string between adjacent pipe lengths while maintaining torque transmitting engagement of the contacting means with the drill string. The drilling rig can also include selectively operable means releasably engageable with a drill string in the torque transmitting means for securing the drill string from downward movement relative to the rotary table.

DESCRIPTION OF THE DRAWINGS

The above-mentioned and other features of this invention are more fully set forth in the following detailed description of presently preferred embodiments of the invention, which description is presented with reference to the accompanying drawings wherein.

DESCRIPTION OF THE ILLUSTRATED EMBODIMENTS

Figure 1:
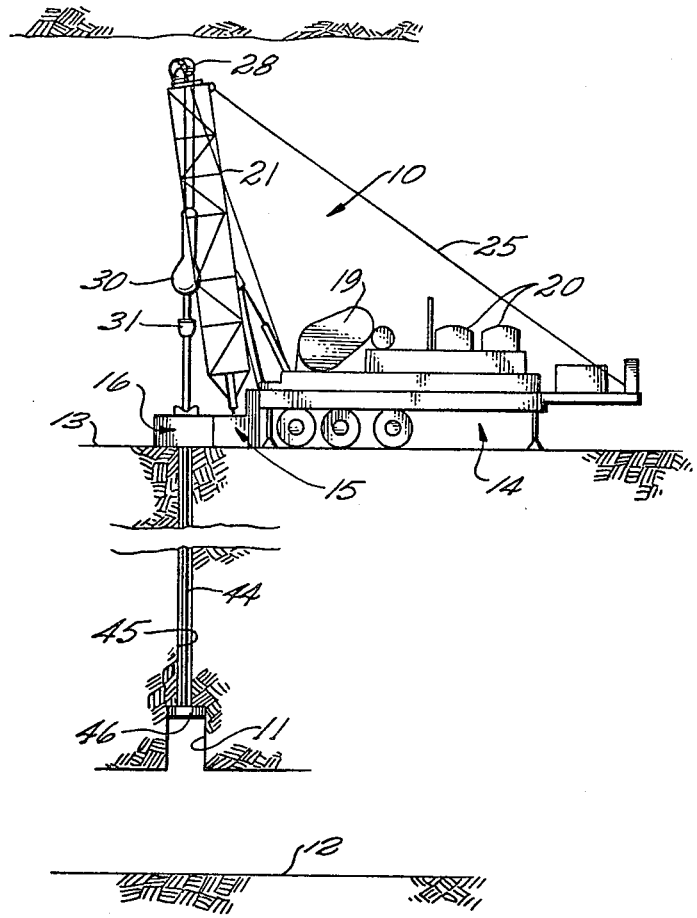
FIG. 1 is a elevation view showing an improved raise boring rig of this invention in use boring a raise in a mine.
Figure 2:
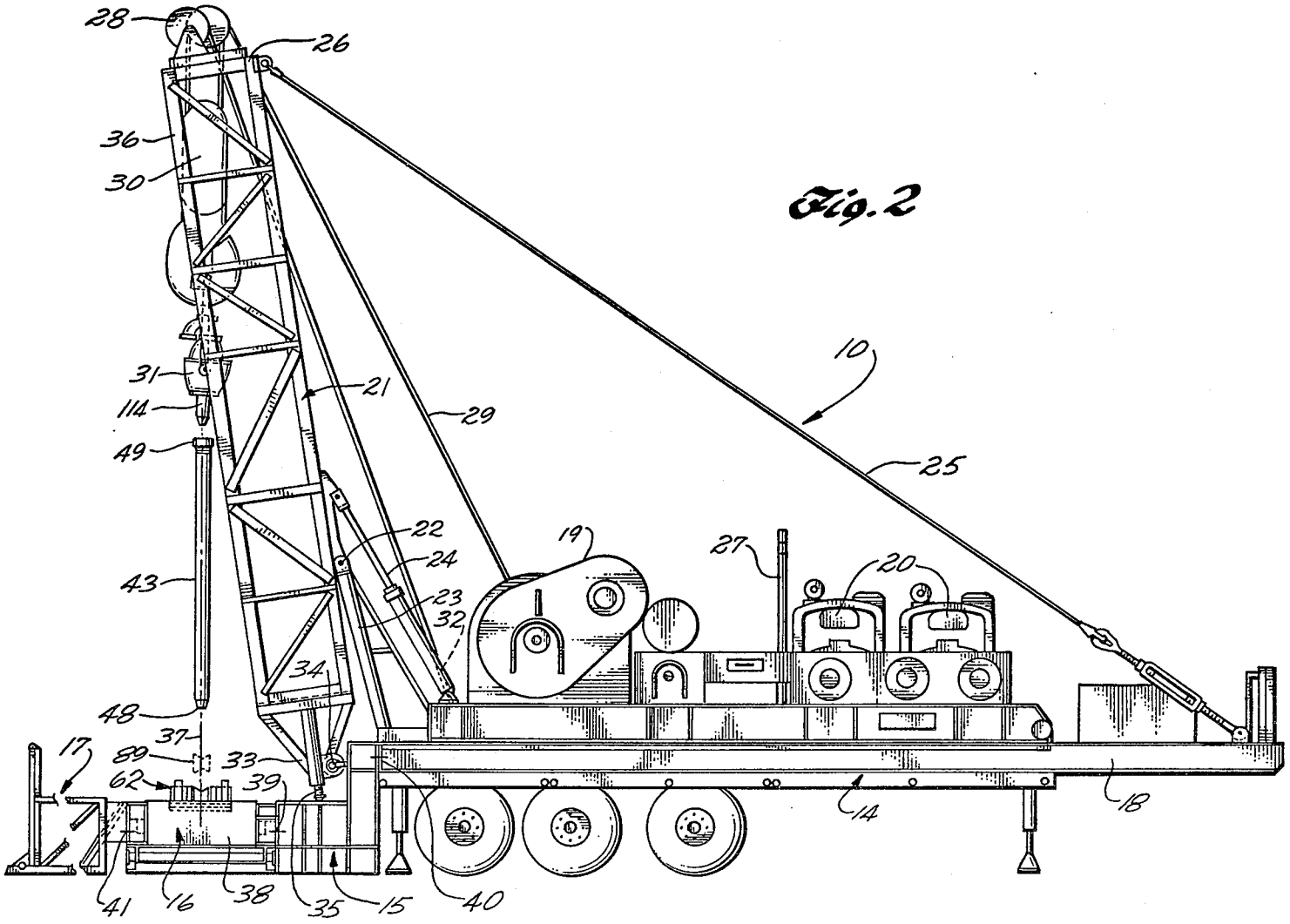
FIG. 2 is an enlarged elevation view of the operating raise boring rig.

FIGS. 1 and 2 show an improved raise boring rig 10 in operation boring a raise 11 from a tunnel of room 12 at a lower level in a mine to a tunnel 13 at an upper level of the mine. As to raise 11, lower tunnel 12 is the initiation point of the raise, and the upper tunnel 13 is the working area at which the boring rig is located and the boring procedure is principally performed. The deposit being developed by the mine may be oil shale, and the raise can be formed as a step in the process of the in situ recovery of oil from the shale.

Boring rig 10 is composed principally of a drawworks trailer 14, a substructure 15 connected between the rear o the drawworks trailer and a rotary tabl unit 16 of modular design located on the floor of tunnel 13. As shown in FIG. 2, the boring rig also includes a drill pipe storage rack 17 attached to the side of the rotary table unit opposite from the drawworks trailer.

Figure 3:
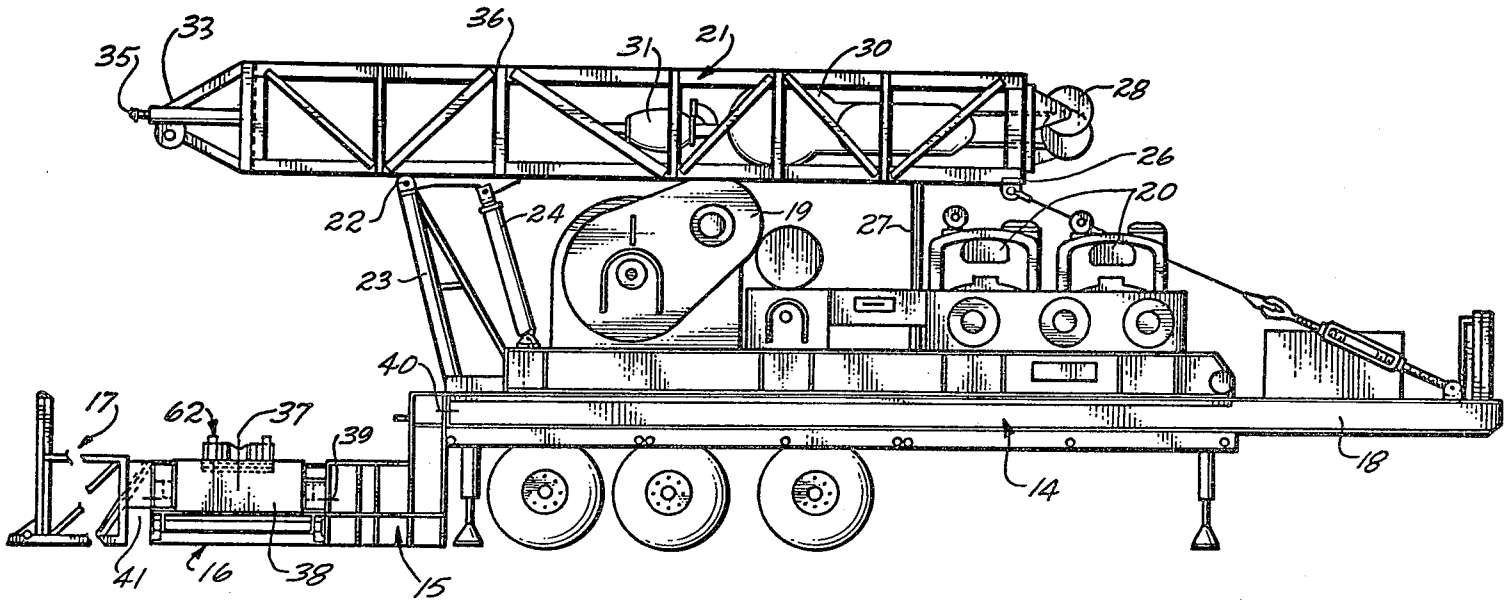
FIG. 3 is an elevation view of the raise boring rig showing the rig derrick in its retracted and stowed position.

As shown in FIGS. 2 and 3, drawworks trailer 14 includes a chassis 18 having wheels adjacent its rear end; during drilling operations, the trailer chassis is levelled and supported by hydraulic and screw jacks rather than by the wheels. A wire rope drawworks 19 is mounted to the chassis adjacent the rear end of the trailer. A power source such as a pair of diesel engines 20 is mounted to the chassis forwardly of the drawworks and is connected in tandem to the drawworks for powering the same. A derrick mast 21 of trusslike arrangement is hinged, as at 22, to the upper ends of a pair of upwardly and rearwardly extending struts 23 which have their lower ends affixed to the chassis at the extreme rear end of the trailer. The derrick mast is hingeable between its erect position (see FIG. 2) and its retracted position (see FIG. 3) by operation of a double-acting hydraulic ram 24 coupled between the mast and the chassis. When the mast is in its erected position, a belly stay 25 is coupled between the upper end 26 of the mast and the forward end of the chassis for accommodating the loads applied to the mast during the course of raise boring, and for stabilizing the position of the mast. When the mast has been hinged about hinge axis 22 from its erected position to its retracted position, the mast is supported adjacent its upper end on a derrick support frame 27 mounted to the chassis forwardly of the drawworks.

A suitable crown block 28 is mounted at the upper end 26 of derrick mast 21. A wire rope cable 29 is reeved on the main drum of drawworks 19 and extends from the drawworks via the crown block into the derrick mast where it is rigged, with appropriate mechanical advantage, to a travelling block 30. A suitable travelling block is a Baash-Ross No. DBM 330–100 travelling block. A swivel 31, such as an Ideco TRU-LINE TL-120 swivel, is connected by its bail to the hook of the travelling block. The swivel has a rotatable nipple 114 by which the swivel is threadably connectible to a drill string 44. The lower end of the swivel nipple is threaded in a right-hand manner to mate with the female threads in the drill string; if a left-hand threaded swivel is used, a suitable adapter is connected to the swivel nipple to present a male right-hand thread to the upper end of drill string 44. A short combination swivel and block can be used if desired. Wire rope cable 29 has a dead end 32 secured to the drawworks trailer chassis 18 rearwardly of drawworks 19.

As shown in FIG. 2, which illustrates the drawworks unit with the mast in its erected state, the rear face 36 of the drawworks mast is devoid of trusslike structural bracing so that the rear face of the mast is open to permit the travelling block to pass into and out of the mast which, when erected, has its upper end disposed rearwardly of its lower end 33. In its erected position, the lower end of the mast is pinned, as at 34, to substructure 15 to prevent undesired hinging of the mast clockwise about hinge axis 22. The lower end of the mast bears upon substructure 15 via a pair of adjustable screw-jack load-bearing feet 35.

As shown in FIG. 3, when mast 21 is in its horizontally retracted and stowed position, travelling block 30 and swivel 31 can be stowed within the mast. Accordingly, the forward face of the mast, in addition to the trusslike struts and braces of the character shown in FIG. 3 for the opposite side faces of the mast, includes additional structural elements which provide a support for the travelling block and swivel in the stowed positions thereof.

As shown best in FIG. 2, the erected position of the mast is such that the rearward inclination of the mast is sufficient to place the crown block 28 vertically in line with the axis 37 of an opening through a rotary table 38 mounted to one end of rotary table unit 16. The rotary table skid unit can be, and preferably is supported directly upon the floor of tunnel 13 by a plurality of screw-jack leveling feet (not shown) incorporated within the skid unit adjacent each of the four corners thereof. The rotary table unit is pinned or bolted, as at 39, to substructure 15 which also is supported directly upon the tunnel floor. The substructure is in turn pinned or bolted, as at 40, to the rear end of drawworks trailer chassis 18, as shown best in FIGS. 2 and 3. The drill pipe rack 17 can be bolted, as at 41, to the side of the rotary table unit opposite from the drawworks trailer adjacent the position of rotary table 38. Rack 17 serves to store drill pipe joints 43 prior to their connection into drill string 44 during the course of drilling a pilot hole 45 for raise 11. Rach 17 also serves as a storage location for joints removed from drill string 44 by the procedure described below during drilling of raise 11.

In rig 10, rotary table 38 and drawworks 19 comprise drive means for rotating the drill string about axis 37 and for moving the drill string along the axis.

To use raise boring rig 10, the rig is assembled, in the manner described above and as shown in FIG. 2, at such a position in tunnel 13 that the axis 37 of rotary table 38 is aligned vertically with the centerline of the described raise 11. The rig is then operated as described below, to drill pilot hole 45 from tunnel 13 downwardly to tunnel 12. In the in situ oil shale recovery process referred to above, the vertical distance between tunnels 12 and 13 can be on the order of several hundred feet. In drilling pilot hole 45, the drill string can be made up with a kelly and the drill string as is commonly used in rotary drilling, with the drill string carrying at its lower end a rock drilling bit. If a drill string and kelly are used in drilling the pilot hole, the drill string and the pilot hole bit are withdrawn from the pilot hole after the lower end of the pilot hole breaks through into tunnel 12. Improved drill string 44 is then made up and lowered through the pilot hole until the lower end of the drill string extends into tunnel 12. A raise bore bit 46 is then secured to the lower end of drill string 44 (see FIG. 1), and boring rig 10 is thereafter operated according to the procedures described below to bore raise 11 upwardly from tunnel 12 toward tunnel 13. If drill string 44 is used in conjunction with a conventional bit to drill pilot hole 45, the drill string is not extracted from the pilot hole upon breaking through to tunnel 12. Instead, the pilot hole bit is removed from the drill string at tunnel 12 and raise bit 46 is connected to the lower end of drill string 44. Thereafter, raise 11 is bored by use of the procedures described below.

Raise boring drill string 44 is composed of a plurality of individual lengths (joints) 43 of drill pipe. Joints 43, along the entirety of their length except at their extreme ends, as described below, are of non-round transverse cross-sectional configuration. Preferably, the non-round external cross-sectional configuration of each drill pipe joint 43 is a uniform regular (i.e., equilateral) polygon. The polygon can be either a hexagon or a square, but the cross-sectional configuration of the drill string can be any other regular polygon desired.

One end, the lower end 48, of each joint 43 is tapered and externally threaded to define a male component or moiety of an axial threaded connection for connecting the joint into drill string 44. The male end of the joint is referred to as the pin end of the joint. Each drill pipe length 43 can be axially bored. An upwardly-open tapered portion of the other end, the upper end 49, of each joint 43 is internally threaded axially along the joint so as to define a cooperating female component or moiety 49 of the threaded connection for connecting the joint into the drill string 44. The female end of the joint is referred to as its box end. While, as noted below, it is possible for each joint 43 to be of uniform regular hexagonal cross-sectional configuration at all points along its length above the male threaded end thereof, it is preferred in accord with this invention that the shape of the joint, at least at the female moiety 49, be of right circularly cylindrical configuration. The diameter of the cylindrical portion of each joint 43 has a diameter which is at least as great as the greatest transverse dimension of the non-round portion of the joint.

Preferably, the cylindrical external cross-section of each pipe joint 43 has an extent axially of the joint which is somewhat greater than the depth of the internally threaded female moiety of the threaded connection to enable remachining of the upper end of the joint in the event that the internal threads are stripped or cross-threaded during use. In a pipe joint 43 of 7 inch diameter, the axial extent of the cylindrical portion of the pipe joint can be on the order of 7 to 8 inches, with the total length of the pipe joint being on the order of about 9½ feet, although longer joints can be used, as where overhead clearances are not of concern. The length of the cylindrical portion of the joint can be greater than the diameter of the cylindrical portion, but it is preferred that it not be longer than about one and one-half to two times the joint diameter; as will be seen from the following description, the length of the joint cylindrical portion affects the height of the drive bushing 62 used in rotary table 38 to rotate drill string 44 during boring of raise 11.

In a presently preferred embodiment of the invention, each hexagonally cross-sectioned pipe joint 43 is fabricated from a length of cylindrical drill pipe having an outer diameter of 7 inches. Such pipe joints are fabricated by machining away the outer surface material of the joint to define the desired regular hexagon over substantially the length of the drill pipe between the male and female connection moieties as described above.

It will be apparent that, except for the short cylindrical interjoint connection features at periodic locations along the length of drill string 44, the drill string is in effect a kelly. In this way, rotary motion applied to the rotary table can be transferred to the drill string disposed through an opening in the rotary table coaxially of axis 37. The rotary table includes a component configured to mate with the non-round external cross-section of the drill string so as to apply torque to the drill string, while accommodating axial upward motion of the drill string in response to upward cutting of the raise bit.

In down-hole drilling using a rotary table drilling rig and a kelly, as is common in the oil and gas industry, the upper end of the kelly is never required to pass through the torque transmitting bushing mounted coaxially within the rotary table. In raise boring by use of drill string 44, however, the cylindrical end of a pipe joint is required to pass through the torque transmitting bushing mounted in the rotary table. Accordingly, as compared to more common down-hole rotary table drilling rigs, raise boring rig 10 of this invention includes means which are (1) rotatable about axis 37, (2) configured to mate with the non-round portion of the drill string for transmitting torque to the drill string, (3) arranged to accommodate axial movement of the drill string, and (4) arranged to effectively permit passage of an interjoint connection in the drill string through it without interrupting the transmission of torque to the drill string. These characteristics are provided in the torque transmitting means of raise boring rig 10 in order that an interjoint connection between adjacent pipe joints 43 may be made accessible at the rotary table for disconnection of the uppermost joint from the drill string. A torque transmitting means useful with drill string 44 and having these characteristics is provided by bushing 62 which is illustrated in FIGS. 6, 7, 8 and 9.

Figure 4:
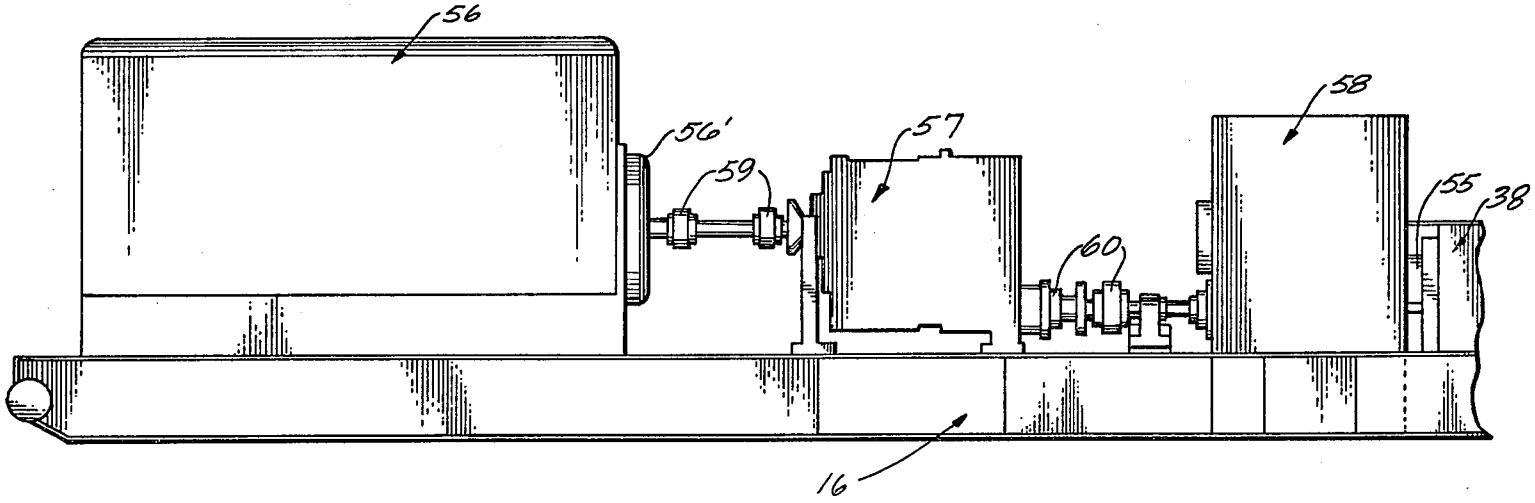
FIG. 4 is an enlarged fragmentary elevation view of the rotary table skid, the same being a component of the rig shown in FIGS. 1 and 2.
Figure 5:
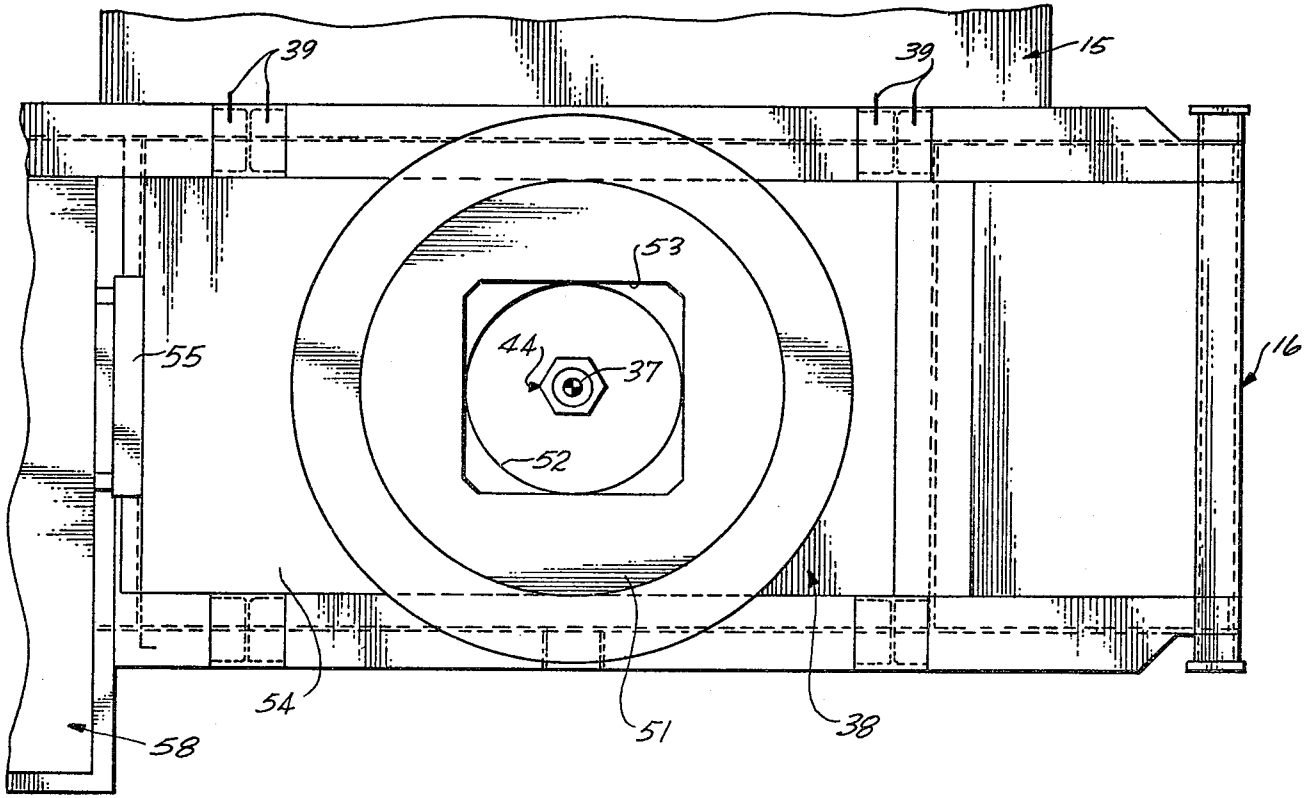
FIG. 5 is a fragmentary top plan view of the portion of the rotary table skid which is not shown in FIG. 4.

As shown in FIG. 5, rotary table 38 includes an annular rotatable collar 52 mounted for rotation about axis 37. The collar has a central circular opening 52 formed through it and through which drill string 44 is raised during raise bore drilling operations. An essentially square recess 53 is formed in the upper surface of the collar concentric to axis 37. Collar 51 can be a part of a commercially available rotary table, such as an Ideco rotary table, Model No. SH-23-D-13. Within such rotary tables are means engageable between the collar and an input drive shaft, which enters the rotary table housing through an input shaft assembly 55, for rotating the collar. The rotary table and collar 51 thereof are driven by a power train which is mounted to rotary table skid unit 16 and which, as shown in FIG. 4, includes a diesel engine 56, a three-speed transmission 57 which can be of the Allison planetary type, and a drive reduction mechanism 58 which can be a roller chain-sprocket type speed reducer. The diesel engine is mounted to the end of the skid unit opposite from rotary table 38 and has its output shaft connected via a torque converter 56' and by suitable couplings 59 to the input shaft of transmission 57. The transmission output shaft is coupled by suitable couplings 60 to the input shaft of reduction mechanism 58 which has its output shaft coupled to the internal gearing of the rotary table via input shaft assembly 55.

Rotary table drilling rigs of the type used in the oil and gas industry commonly include only a single engine or other power source which is used to drive both the drawworks and the rotary table. In drilling oil or gas wells, the rotary table is usually powered during periods when the drawworks is not powered, and vice versa. In raise drilling with rig 10, however, the maximum drawworks power requirements and the maximum rotary table power requirements exist simultaneously and continuously. It is for this reason that, in rig 10, the rotary table 38 has its own power source, complete with engine, torque converter, transmission and chain reduction mechanism. This is a significant difference between the raise bore drilling rig described herein and rotary table drilling rigs used in the oil and gas industry.

Figure 8:
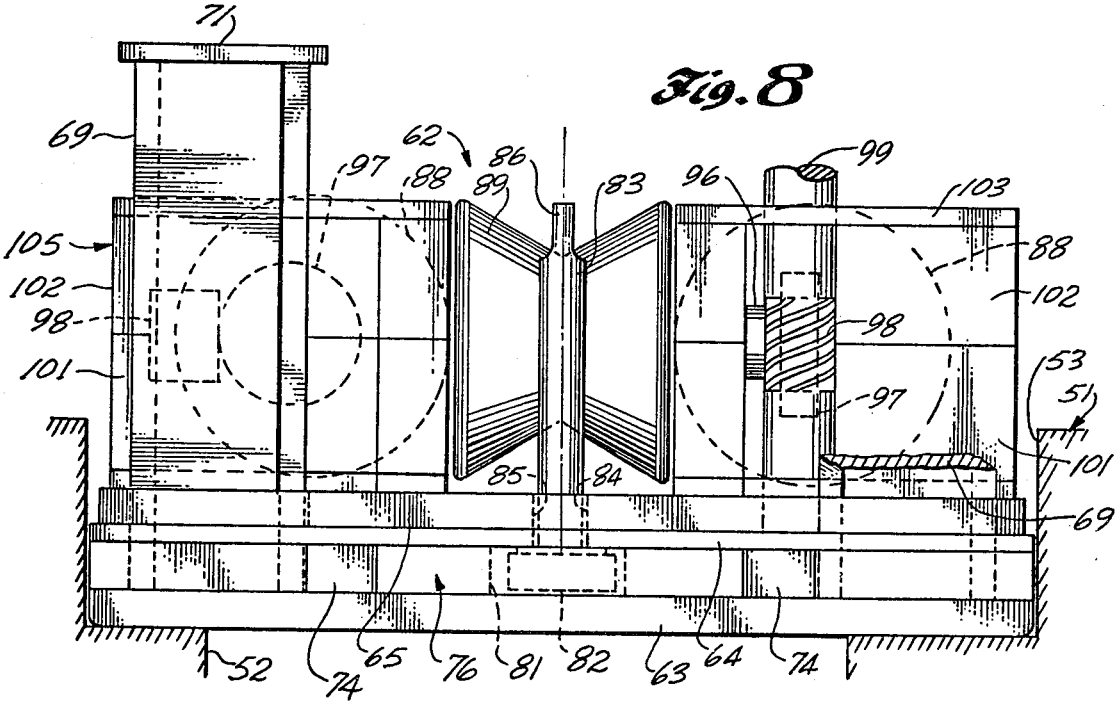
FIG. 8 is an elevation view, with parts broken away, of the drive bushing shown in FIGS. 6 and 7.
Figure 6:
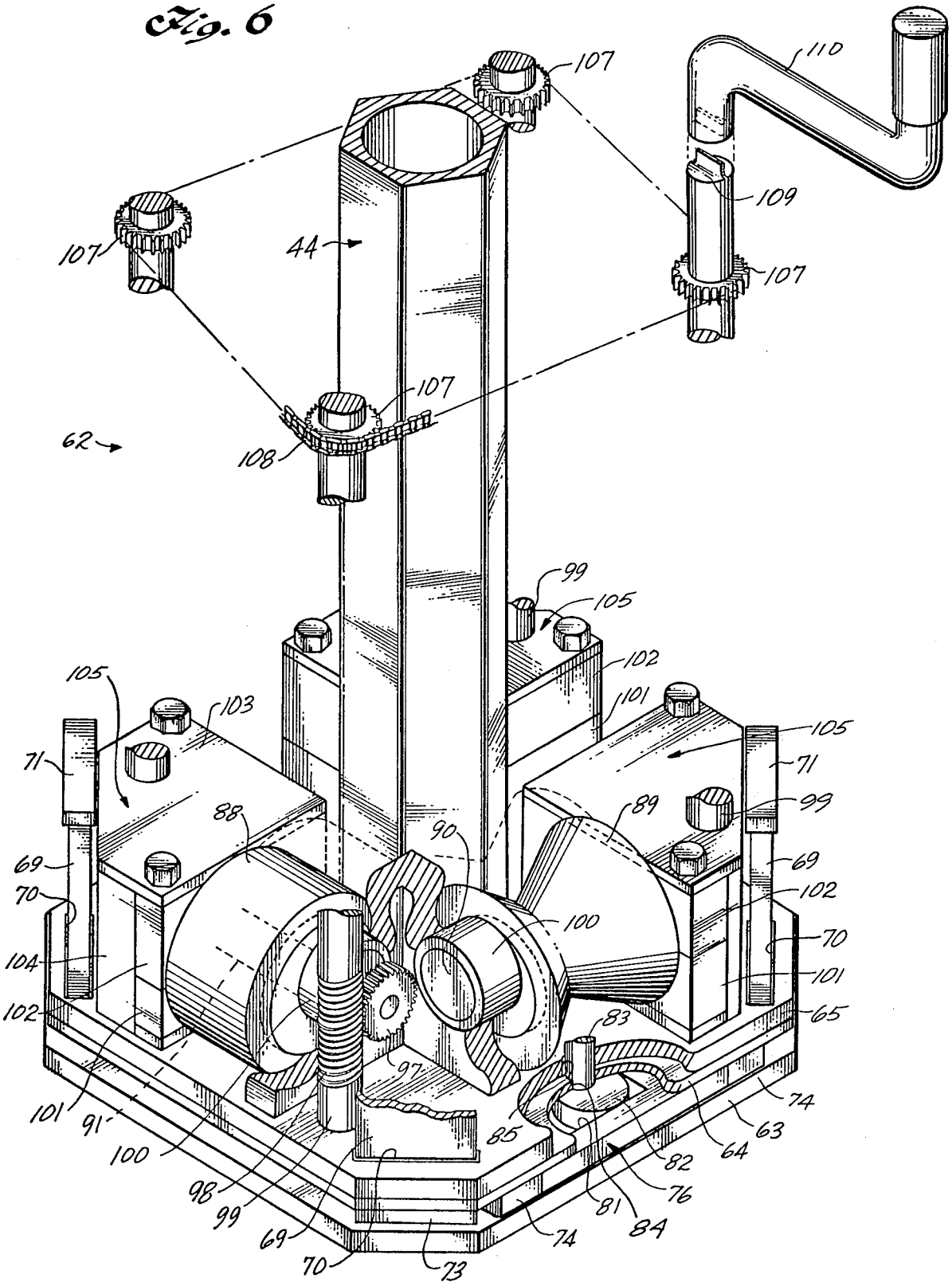
FIG. 6 is a partially exploded perspective view, with parts broken away, of an improved drive "bushing" in the raise boring rig.
Figure 7:
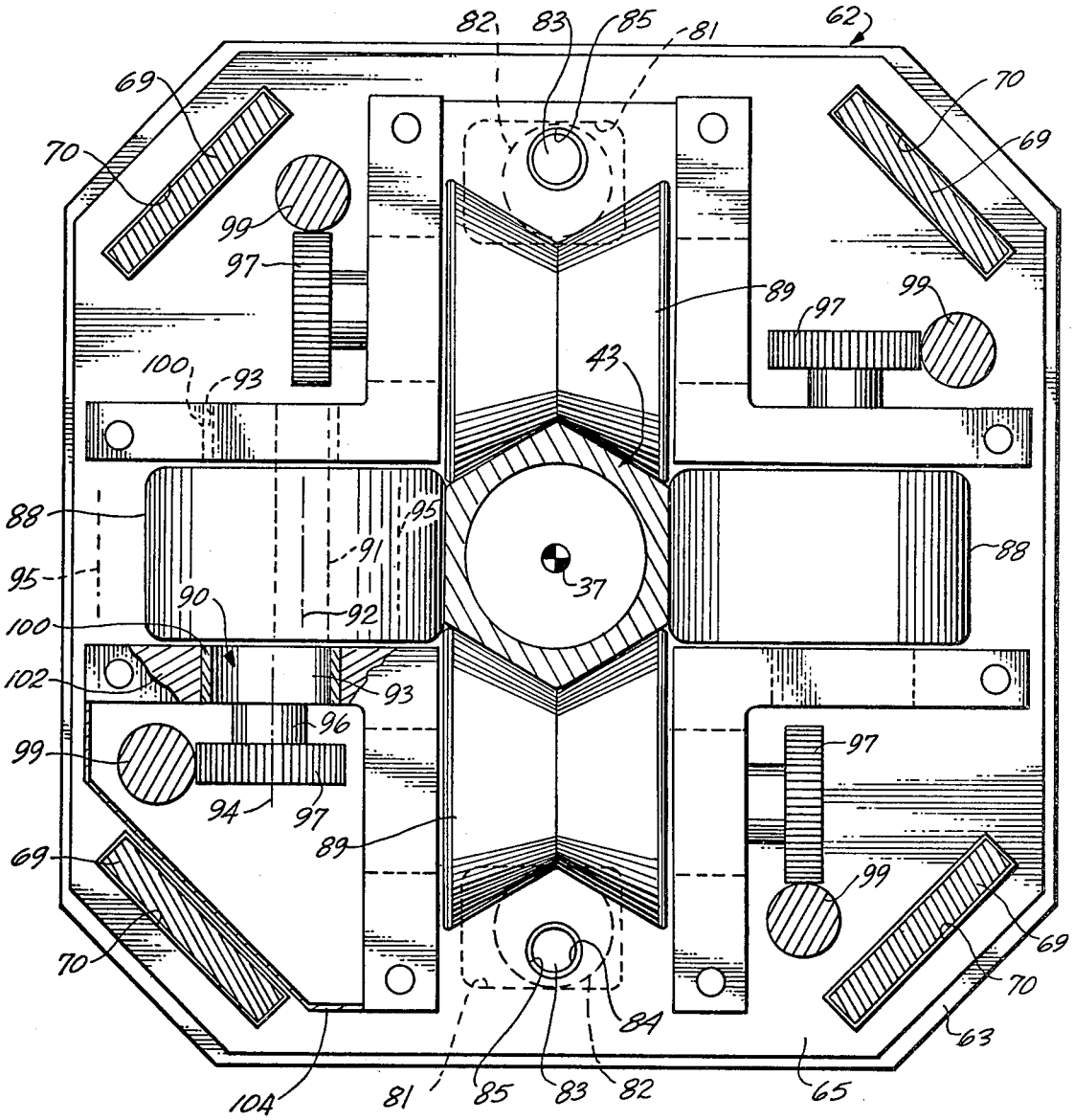
FIG. 7 is a top plan view, with parts broken away, of the drive bushing shown in FIG. 6.

In a rotary table drilling rig for use with a kelly and round drill string, a suitable kelly bushing is disposed in recess 53 to be concentric to axis 37 and to be rotated about the axis in response to rotation of the collar 51 about the axis. In raise bore drilling rig 10, a torque transmitting assembly 62 (herein sometimes referred to as a bushing), shown in FIGS. 6, 7 and 8, is mounted within rotary table recess 53 to cooperate with the non-round cross-sectional configuration of drill string 44 for transmitting torque to the drill string while accommodating axial motion of the drill string. The term "bushing" is used as descriptive of torque transmitting assembly 62 because assembly 62 is used in place of a kelly bushing in a rotary table for a drilling rig and serves all of the functions of a kelly bushing plus additional functions.

Figure 10:
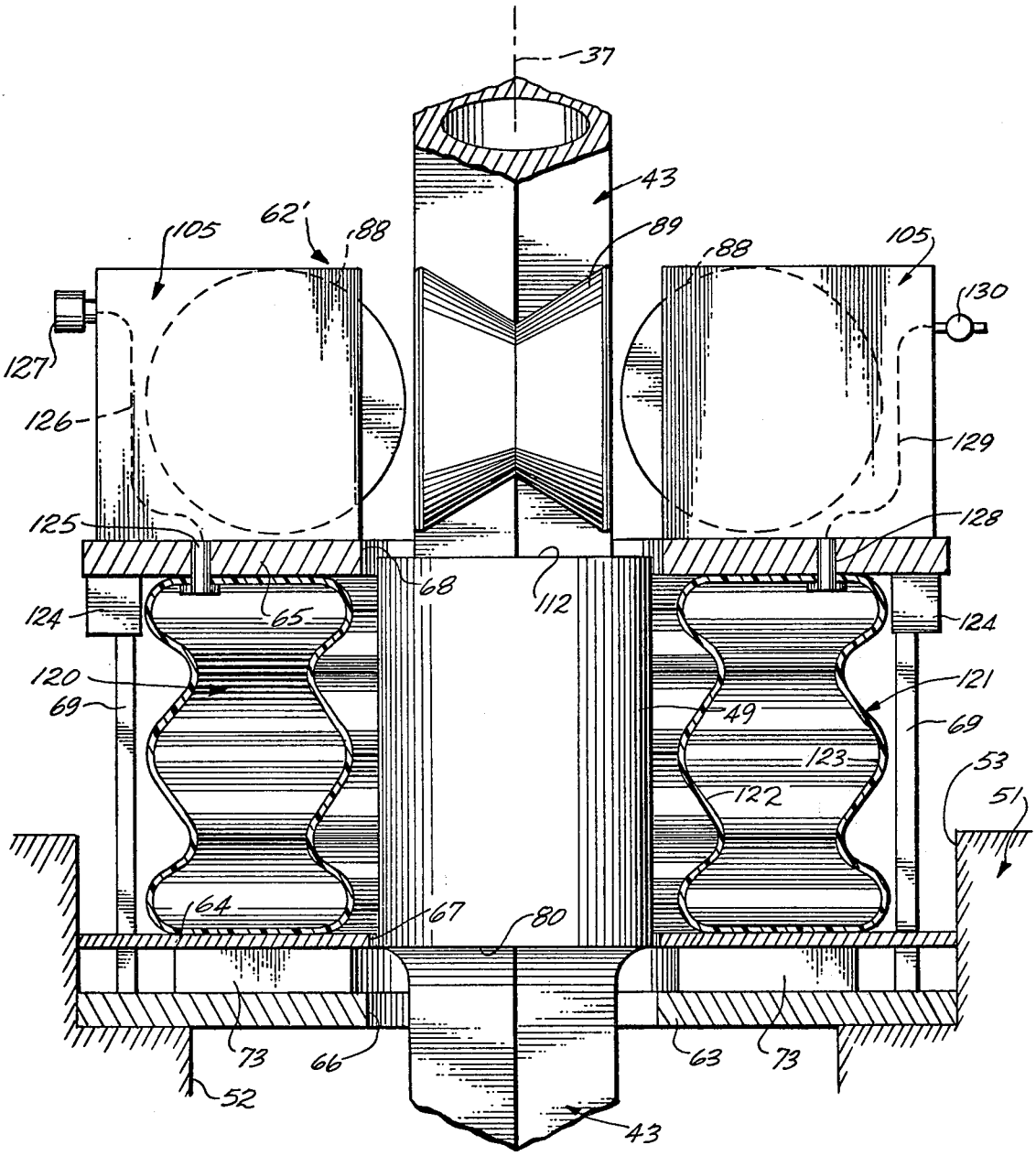
FIG. 10 is an elevation view, similar to FIG. 8, of another drive bushing according to this invention.

In the illustrated embodiment of this invention, bushing 62 is comprised of a bottom plate 63, an intermediate plate 64 and a top plate 65. These three plates are generally square but have chamfered corners. The bottom and intermediate plates, as shown in FIG. 8, are somewhat larger than the top plate so as to mate snugly within recess 53 of rotary table collar 51 for keying bushing 62 to rotate with the collar about axis 37. The bushing can be secured to the rotary table collar by bolts (not shown) passed through the intermediate and bottom plates into the base of recess 53 outwardly of central opening 52, thereby securing the base of the bushing from moving vertically in the rotary table. As shown in FIG. 10, the bottom, intermediate and top plates of bushing 62 all have central openings 66, 67 and 68, respectively, formed through them; these openings are larger in diameter than the diameter of the cylindrical portion of drill pipe joint 43.

Top plate 65 is vertically movable along axis 37 relative to the bushing bottom and intermediate plates, and four vertical guide members 69 comprise means in the bushing for guiding top plate in such movement. The guide members are fixed to the bottom and intermediate plates and pass through openings 70 formed adjacent each of the four corners of top plate 65. Guides 69 and openings 70 cooperate to secure the top plate from angular movement about axis 37 relative to the bottom and intermediate plates of the bushing. The guides are disposed parallel to the rotary table axis and have stop members 71 at their upper ends. The stop members are larger than openings 70 to prevent the top plate from moving upwardly off guides 69. The motion afforded by guides 69 to top plate 65 upwardly from the base position of the top plate (in which the top plate is supported by intermediate plate 64), is a selected amount greater than the extent of the cylindrical portion 49 of a pipe joint 43 along the length of the pipe joint.

Figure 9:
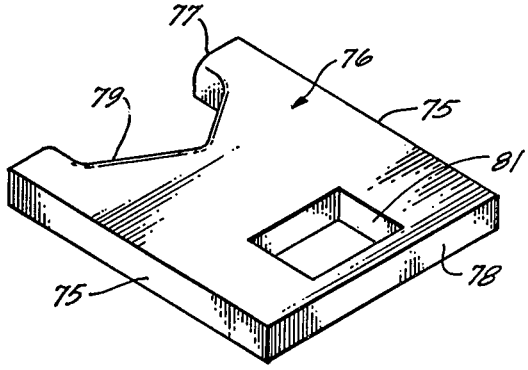
FIG. 9 is a perspective view of one of the two identical drill string holding tools included in the drive bushing.

Means connected to the rotary table are provided for holding drill string 44 in the rotary table while a pipe joint is being removed from the upper end of the drill string. In the embodiment of the invention illustrated, the holding means are provided in bushing 62. To provide the drill string holding means, the intermediate plate is spaced above bottom plate 63 by appropriate spacer blocks 73 and by four holding tool guides 74 shown in FIGS. 6 and 8. Two pairs of holding tool guides 74 are provided and are disposed on opposite sides of the bottom and intermediate plate central openings 66 and 67 so that the guides in each pair are aligned with each other. The holding block guides are aligned parallel to a radius from rotary table axis 37 and are spaced equally on opposite sides of such radius. Each pair of holding block guides 74 cooperates with opposite sides 75 of a respective one of a pair of holding tools 76 (see FIG. 9). The holding tools are constrained by their cooperating guides 74 to move only linearly toward and away from the rotary table axis between an engaged position (represented in FIG. 15) and a retracted position. Each holding tool has an inner end 77 and an outer end 78. A recess 79 is formed in the inner end and has a configuration which is approximately one-half the periphery of an equilateral hexagon having the same dimensions as the hexagonal configuration of the major portion of the length of each pipe joint 43. When the holding tools are in their engaged positions, the inner ends thereof essentially abut each other to define an hexagonal opening corresponding substantially exactly to the external configuration of a pipe joint. As shown in FIG. 9, the boundaries of recess 79 in each holding tool are contoured to mate with the contour of a pipe joint in that portion thereof which constitutes the transition between the cylindrical portion 49 and the non-round cross-sectional configuration of the joint. Stated in another way, the cylindrical portion 49 of each joint 43 has a diameter which is at least equal to the greatest transverse dimension across the non-round portion of the joint. Thus, each joint, at the lower end of the cylindrical upper terminal portion 49 thereof, defines a downwardly facing shoulder 80 (see FIG. 10). The boundaries of holding tool recesses 79 are configured to mate with this shoulder to prevent a pipe joint engaged by the holding tools from falling downwardly out of bushing 62. The holding tools provide selectively operable means in rig 10, separate from the drawworks, for holding the drill string from downward movement in the rig, thereby preventing loss of the drill string down the pilot hole and te raise during those periods when the drill string is disconnected from swivel 31.

A rectangular opening 81 is defined in each holding tool 76 adjacent its outer end 78. A circular operating cam 82 cooperates in each opening 81, as shown in FIGS. 6 and 7. Each cam is mounted to the lower end of a circular actuating shaft 83 so as to be eccentric to the shaft. The throw of the cam, when the actuating shaft is rotated 180 degrees, is equal to the linear travel of the holding tool in moving between its engaged and retracted positions. The actuating shaft extends upwardly parallel to rotary table axis 37 from the operating cam through appropriate openings 84 and 85 in the intermediate and top plates, respectively. The upper end 86 of each actuating shaft is configured to cooperate with a removable crank handle similar to crank handle 110 shown in FIG. 6. Openings 81 and cams 82 comprise selectively operable means for moving the holding tools into and out of engagement with the drill string. If desired, actuating shafts 83 can be driven by any suitable means, such as by a hydraulic or or pneumatic ram assembly, for example.

As shown in FIGS. 6 and 7, in an embodiment of a drill string drive bushing for use with a drill string of hexagonal cross-sectional configuration, the top plate 65 of bushing 62 carries two cylindrical drive rollers 88 and two biconical drive rollers 89. Cylindrical rollers 88 are disposed for rotation about parallel axes oriented perpendicular to and on opposite sides of axis 37. Biconical drive rollers 89 are rotatable about parallel axes oriented perpendicular to and on opposite sides of axis 37. Rollers 88 and 89 are located on top plate 65 at stations located at 90 degree intervals proceeding circumferentially of axis 37; this is shown best in FIG. 7.

Drive rollers 89 are referred to as biconical because, as shown in FIG. 7 for example, they are conically tapered from maximum diameters at their ends to a minimum diameter at their mid-length and thus resemble two identical truncated right cones joined in abutting relationship at their small ends. The taper angle of the biconical drive rollers is 60 degrees so that, as shown in FIG. 7, rollers 89, when they are in their engaged position toward rotary table axis 37, intimately cooperate with two adjacent faces of the hexagonal transverse cross-sectional configuration of a pipe joint 43. Each roller 89 cooperates with two of the six faces of the hexagonal cross-sectional configuration of the pipe joint, and the cylindrical drive rollers 88 cooperate with respective ones of the remaining two faces of the exterior configuration of the joint when all rollers are in their engaged positions toward the rotary table axis. In this manner, rotary motion of rotary table collar 51 is transferred through bushing 62 to drill string 44 via engagement of drive rollers 88 and 89 with the non-round cross-sectional configuration of the drill string. It is thus apparent that, in bushing 62, rollers 88 and 89 comprise engaging means for engaging the non-round portion of a pipe joint in torque applying relationship and for accommodating axial motion of an engaged pipe joint. Viewed in another way, the rollers comprise drive members for contacting the drill string and for applying torque to the non-round portions of the drill string while enabling the drill string to move axially.

If, as can be the case, the drill string is of square cross-sectional configuration, four cylindrical drive rollers can be used to mate in torque transmitting relation to the four faces of the square portions of the drill string.

In order that the cylindrical upper end portion 49 of a pipe joint may pass from time to time through bushing 62 during the course of raise bore drilling, drive rollers 88 and 89 are retractable away from axis 37 by an amount sufficient to enable cylindrical portion 49 of the pipe joint to move vertically past the rollers. To this end, in the illustrated embodiment of the invention, each of rollers 88 and 89 is carried on an eccentric crank 90 shown best in FIG. 7 in association with drive roller 88 at the 9:00 o'clock position in FIG. 7. A description of the mounting of this roller to its crank will suffice as a description for the mounting of all drive rollers, since all drive rollers are mounted in a similar manner in bushing 62. The cranks and their drive mechanisms are components of selectively operable means, in the torque transmitting bushing, which is operable for effectively expanding the bushing to enable a cylindrical portion of a pipe joint 43 to pass through the bushing.

Drive roller 88 is rotatably mounted by suitable internal bearings for rotation about a wrist pin portion 91 of crank 90. Wrist pin portion 91 is associated with axis 92 which is the axis about which roller 88 rotates. Wrist pin portion 91 is connected at each of its opposite ends to respective ones of a pair of arm sections 93 of the crank. The arm sections are circular and coaxially aligned along an axis 94. The spacing between axes 92 and 94 is equal to one-half the throw of crank 90 and, in a presently preferred embodiment of bushing 62, is equal to $\frac{5}{8}$ inch so that, upon rotation of crank 90 through an arc of 180° about axis 94, roller 88 is moved laterally in bushing 62 a distance of 1 $\frac{1}{4}$ inches from its torque transmitting engaged position (shown in full lines in FIG. 7) to its retracted position represented by broken lines 95 in FIG. 7. In order that crank 90 may be rotated 180 degrees about axis 94, a stub shaft 96 extends coaxially of axis 94 and is connected to one of arm sections 93. The stub shaft carries a worm gear 97. The worm gear meshes with a worm 98, see FIGS. 6 and 8, defined in the exterior of a vertical shaft 99 rotatably mounted to top plate 65 for vertical movement with the top plate. Each circular arm section 93 of crank 90 is rotatably mounted by a suitable bearing 100 in an opening defined by cooperation of upwardly and downwardly opening recesses in each of a pair of bearing mounting members 101 and 102, see FIG. 6. Each pair of bearing mounting members 101 and 102 receives and supports a bearing 100 for a cylindrical drive roller 88 and the adjacent bearing for a biconical drive roller 89, the respective bearings defining axes which interesect each other at an angle of 90 degrees. Preferably, gear 97 and worm 98 are immersed in oil within a housing 105 defined by top plate 65, bearing mounting blocks 101 and 102, a cover plate 103 and a closure plate 104, as shown in FIGS. 6 and 7.

A worm gear 97 and a worm 98 are provided for each drive roller; there are four worm shafts 99 provided in drill string drive bushing 62 at locations spaced 90° about the rotary table axis. Whereas holding tools 76 can be operated independently of each other, it is preferred that drive rollers 88 and 89 be moved simultaneously between their engaged and retracted positions. Accordingly, each work shaft 99, at a location spaced appropriately above corresponding housing 105, carries roller chain sprocket 107, all sprockets 107 being at the same elevation above top plate 65. A continuous loop of timing chain 108, or the like, is engaged with each of sprockets 107. The upper end 109 of one of the worm shafts is configured to mate in torque transmitting relation with a removable crank mate in torque transmitting relation with a removable crank handle 110 by which all work shafts 99, by virtue of the interconnection by chain 108, are all rotated together in the same direction to cause rollers 88 and 89 to move concurrently between their engaged and retracted positions in response to rotation of worm gears 97. If slack in the chain 108 is a matter of concern, a chain tensioning idler sprocket (not shown) can be provided; if provided, the idler sprocket can be mounted to a suitable adjustable carrier mounted to one of housings 105. Also, chain 108 can be driven, if desired, by a hydraulic motor mounted to the bushing structure and having a drive sprocket engaged with the chain. If a hydraulic motor is used, it is equipped with quick-disconnect fittings in its hydraulic fluid supply and discharge ports so that the motor can quickly be disconnected into a suitable hydraulic system in the raise bore drilling rig itself when the rotary table is not being operated.

Figure 11:
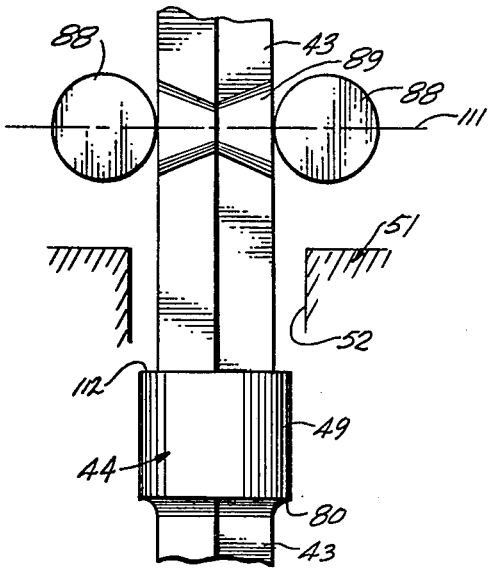
FIGS. 11, 12, 13, 14, 15 and 16 are schematic representations of the drive bushing shown in FIGS. 6, 7 and 8 at various intervals during the course of boring a raise.

To carry out raise boring operations with rig 10, the rig is erected in the manner described above. Pilot hole 45 is drilled through the floor of tunnel 13 in the mine until the pilot hole emerges into tunnel 12. If the pilot hole is drilled using the non-round drill string 44 described above, the bit used to drill the pilot hole is removed from the lower end of drill string 44 and a suitable raise bore drilling bit 46 is connected to the lower end of the drill string. Raise bore drilling operations are then commenced. In raise bore drilling operations, torque is applied to the drill string 44 via bushing 62 in response to rotation of collar 51 in rotary table 38. Appropriate axial tension is generated in the drill string by operating drawworks 19 to take in cable 29, thereby raising travelling block 30 and swivel 31 which has a nipple 114 threaded for coupling with the female coupling moiety at the extreme upper end of the raise bore drill string. Assume that at the time raise bore drilling operations are commenced, drive rollers 88 and 89 are in their base position, i.e., their lower limit of travel vertically relative to the drive bushing bottom plate 63; also assume that the rollers are in their engaged position to mate in torque transmitting relation with the regular polygonal cross-sectional configuration of drill string 44. This is the situation illustrated in FIG. 11 in which broken line 111 represents the base position of rollers 88 and 89.

Figure 12:
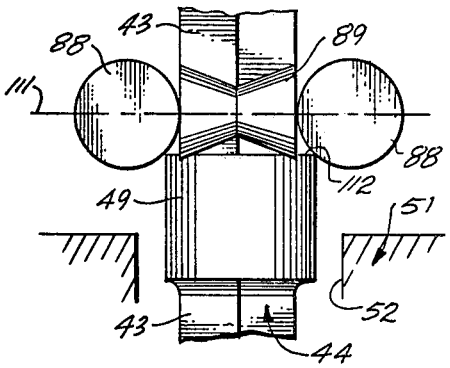
Figure 13:
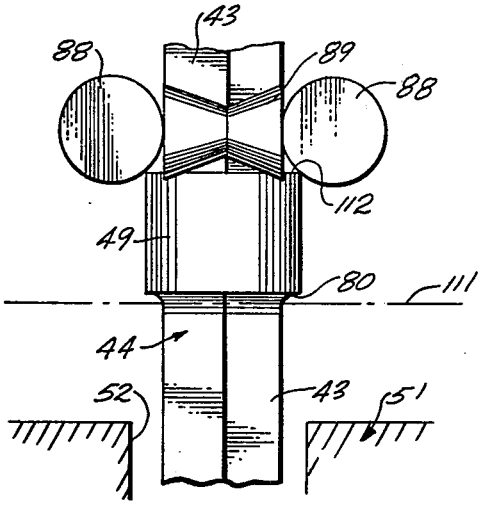
Figure 14:
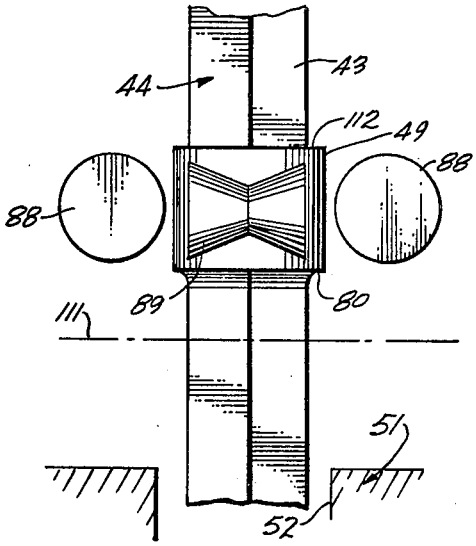

As raise bore drilling operations are continued, the upwardly directed axial force applied to the drill string, in conjunction with rotation of the drill string, causes bit 46 to cut upwardly. The raise drilling proceeds until the upwardly open shoulder 112, defined at the upper end of the cylindrical portion 49 of a pipe joint 43, moves into engagement with drive rollers 88 and 89; this is the situation illustrated in FIG. 12. At this point, further upward motion of the drill string causes the drive rollers, as a group, to be raised upwardly from their base position, the rollers carrying bushing top plate 65 with them. Upward movement of the top plate is guided by guide members 69 which also cooperate with the top plate to prevent the top plate from turning about axis 37 relative to the remainder of bushing 62 and rotary table collar 51. Accordingly, continued operation of the rotary table is effective to apply torque to the drill string as the drive rollers, as a group, move upwardly in response to engagement with drill string shoulder 112; see FIG. 13. Continued upward and rotary motion of the drill string proceeds until the drive rolles reach their upper limit of travel relative to bottom plate 63. At that point, further reeling in of cable 29 and further operation of the rotary table are discontinued. Tension is maintained on the drill string by drawworks 19 as rollers 88 and 89 are moved into their retracted positions by operation of the roller retraction mechanism described above. This situation is shown in FIG. 14 which depicts the bushing top plate in the process of being returned to its base position 111, by gravity, following retraction of the drive rollers from engagement with the drill string above interjoint connection moiety 49.

Figure 15:
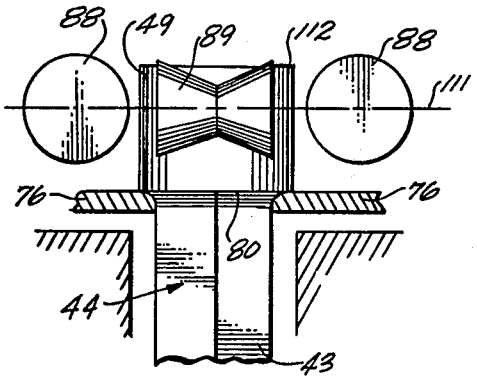

FIG. 15 shows the drive rollers returned to their base position 111 while retracted so as to clear the maximum diameter of the pipe joint at connection 49. FIG. 15 also shows holding tools 76 engaged with the drill string at downwardly facing shoulder 80 to prevent the drill string and raise bore bit 46 from falling downwardly through raise 11 and the pilot hole. Once the bushing top plate has returned to its base position and the holding tools have been moved to their engaged position, drawworks 19 is operated to slowly pay out cable 29, thereby allowing the tensile and torsional forces built up in the drill string to be relaxed. Once the drill string internal forces have relaxed, the travelling block is lowered to lower the drill string so that the shoulder 80 bears upon the engaged holding tools, as shown in FIG. 15. The rotary table is then locked to prevent rotation of the collar 51 about axis 37. Suitable tongs or the like are then engaged with the pipe joint above connection 49, and the pipe joint (or stand of pipe joints) extending above bushing 62 is unscrewed from the drill string. In unscrewing from the drill string the joint extending above the bushing, he string is held from rotation by holding tools 76.

Figure 16:
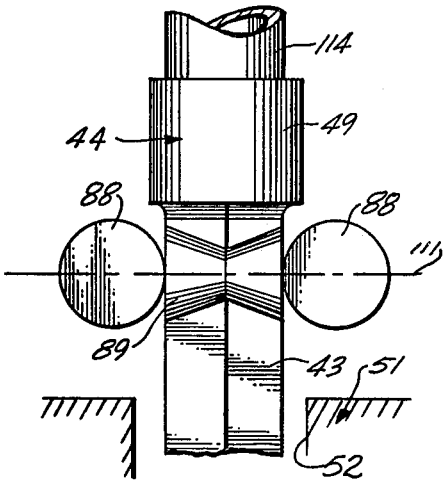

Once the joint above the bushing in the drill string has been removed, and while the drill string in the rotary table is still held from axial and angular movement, travelling block 30 is lowered so that the nipple 114 of swivel 31 can be threaded into the open female moiety of the interjoint coupling in the rotary table. This is shown in FIG. 16. Once swivel nipple 114 has been connected to the upper end of the drill string, cable 29 is taken up so as to lift the connection of the swivel to the drill string to a level which places shoulder 80 sufficiently above the base position of rollers 88 and 89 that the rollers may be moved back into engagement with the non-round cross-section of pipe joint 43 below connection 49, as shown in FIG. 16. Holding tools 76 are then retracted from engagement with the drill string, the rotary table is unlocked, and raise bore drilling operations are continued until the next interjoint connection in the drill string below the rotary tables moves into the position shown in FIG. 12, at which time the procedure described above with reference to FIGS. 11 through 16 is repeated.

It will be apparent from the foregoing that the improved non-round raise bore drill string and the improved drill string drive bushing 62 of this invention meet and overcome the problems heretofore encountered in removing an unneeded joint (or stand of joints) from the drill string during raise bore drilling operations. All operations attendent to removal of an unneeded joint from the drill string are performed at and above the rotary able. There is no need for a person to work below the rotary table in hazardous and cramped quarters. In the raise bore drilling rig illustrated and described, the rotary table is located essentially directly on the tunnel floor, and thus the overall rig height required for drill string joints of given length is reduced. The reduction in height of the rig is a valuable feature when the rig is used in a mine, such as in support of in situ shale oil recovery techniques, where overhead clearances are limited.

Drill string 44 may be used to drill raise pilot hole 45 if desired. In drilling a pilot hole using drill string 44, it is necessary to periodically reverse the sequence of operations illustrated in FIGS. 11 through 16 as an additional pipe joint is from time to time added to the upper end of the drill string. A reversal of the procedure illustrated sequentially in FIGS. 11 through 16 requires that bushing top plate 65 be positively raised from its base position 111 so that drive rollers 88 and 89 can be moved into engagement with the non-round cross-sectional configuration of the uppermost joint of the drill string following its addition to the drill string. Bushing 62' incorporates means for positively raising top plate 65 and is shown in FIG. 10. Bushing 62' is provided in drilling rig 10 if it is desired to use drill string 44 to drill pilot hole 45; in view of the following remarks, it will be apparent that bushing 62' can also be used in the same manner as bushing 62 (FIGS. 6–9) in the course of boring raise 11.

Bushing 62' differs from bushing 62 only by the incorporation in bushing 62' of means for positively raising top plate 65 above intermediate plate 64. In view of this similarity between bushings 62 and 62', the same reference numbers are used with reference to the components of bushing 62' as have been used in describing bushing 62. In view of the many similarities between bushings 62 and 62', those details of bushing 62 which have previously been described are not again set forth in a description of bushing 62'.

A selectively operable lift mechanism 120 is coupled between top plate 65 and intermediate plate 64. Mechanism 120 is operable for raising the top plate above the intermediate plate by an amount equal to the vertical motion afforded, in bushing 62, to the top plate by guide members 69 and stop elements 71. While many lift mechanisms could be coupled between the top and intermediate plates of bushing 62', in the illustrated embodiment the lift mechanism is an annular inflatable air bladder 121, the inner and outer walls 122 and 123 of which preferably are self-folding, in an accordian-fold manner, as the bladder collapses from its fully inflated state to its fully collapsed state. Bladder 121 is disposed concentrically of rotary table axis 37 to engage the underside of top plate 65 and the upper surface of intermediate plate 64. The inner diameter of the bladder, in its fully collapsed state, is greater than the diameter of pipe joint 43 at cylindrical portion 49 thereof, thereby precluding potentially destructive contact of the bladder with an interjoint connection as the connection passes through bushing 62'. A plurality of suitable spacing feet 124 are secured to the underside of top plate 65 circumferentially about the exterior of the bladder. Feet 124 define a predetermined minimum spacing between the top and intermediate plates when the top plate is in its lowermost position along guide members 69. The spacing defined by feet 124 assures that bladder 121 will not be pinched or otherwise too forceably compressed between the top and intermediate plates when the top plate is in its lowermost position, as usually is the case.

An inflation fitting 125 is carried by top plate 65 in an appropriate location and is coupled to the interior of the bladder to provide a port by which inflation air can be introduced to the bladder. Fitting 125 is connected by suitable ducting 126, preferably above the top plate, to a self-closing quick-release compressed air coupling moiety 127 mounted to the top plate in a suitably accessible location. To inflate bladder 121, a suitable air hose, having a self-sealing moiety cooperable with coupling moiety 127, can be used.

To enable deflation of the bladder at the appropriate time, a deflation fitting 128 is carried by the top plate and is coupled to the upper extent of the bladder to provide a deflation port from the bladder. Fitting 128 is connected by suitable ducting 129 from fitting 128 to a manually operable valve 130 mounted, preferably to the top plate, at some suitably accessible location. For example, air hose quick-release fitting 128 and valve 130 can be mounted to the exterior of different ones of roller bearing housings 105.

During raised bore drilling operations using bushing 62', valve 130 can be left open to enable free filling of bladder 121 as the top plate is raised by the drill string, and to enable free venting of the bladder as the top plate falls back to its base position by gravity following disengagement of the drive rollers from the non-round portion of the drill string according to the procedure described above. Free venting of the bladder prevents the presence of the bladder from affecting operation of the bushing during raise bore drilling operations.

The raise bore drill string can be provided in a form which is of uniform non-round transverse external configuration, i.e., constant non-round cross-sectional shape, along its entire length between the rotary table and raise bore bit 46. Such a drill string, however, is considered to be less desirable than drill string 44 according to this invention which is composed of pipe joints 43 having a circularly cylindrical upper terminal portion 49 as described. If an entirely non-round drill string is used, a circumferential recess can be provided in each joint of the drill string adjacent the upper end of the joint at approximately the same distance below the upper end of the pipe joint as the distance between shoulders 112 and 80 of pipe joints 43. Such circumferential recess provides a structural feature in each pipe with, for the purposes of holding the drill string from falling back down the pilot hole, as a no-longer-needed joint is removed.

Also, an entirely non-round drill string is not preferred because such a drill string would require the cross-sectional configuration in any given joint to be aligned with the cross-section of the joints immediately above and below it, at least within relatively close limits. Such alignment of the cross-sectional configurations of adjacent joints in an entirely non-round drill string would be required to enable interjoint connections in the drill string to pass through rollers 88 and 89; in the case of a uniformly non-round drill string, rollers 88 and 89 need not be raisable from a base position in the rotary table. Further, if an entirely non-round drill string of constant cross-sectional area is used, it may not be necessary to provide for retractability of drive rollers 88 and 89.

Workers skilled in the art will appreciate that the internal and external threads of the interjoint connections of a drill string wear during use. The result is that, in an entirely non-round drill string, the angular alignment of the cross-sectional configuration of one joint relative to the configuration of the joint immediately below it may change with time as the drill string is repeatedly taken apart and made up. This gradual change in the angular alignment of the cross-sectional configurations of adjacent pipe joints in such a drill string might require the use of shims or the like between the adjacent joints to assure that the alignment of the adjacent non-round cross-sections is within desired limits. The necessity to use shims in making up a drill string is undesirable; this is a principal reason why drill string 44, which is periodically of cylindrical cross-sectional configuration, is preferred in the practice of this invention. In drill string 44, it is not necessary that the non-round cross-sectional configurations in adjacent pipe joints be aligned with each other; appropriate mating engagement of kelly drive rollers 88 and 89 with the non-round cross-section of the drill string, particularly after performance of the operations illustrated in FIG. 16, can be assured by merely manually moving rotary table collar 51 in the rotary table after the collar has been unlocked and before power is applied to the collar.

There has been described, as apparatus according to this invention, an improved drill string of uniformly non-round transverse cross-section along the length of the drill string. In an improved drill string according to this invention, the drill string is non-round along its length except periodically at the connections between adjacent joints in the drill string. The improved drill string can be used more conveniently and more safely than conventional drill strings to perform raise bore drilling operations, particularly where a bushing, such as either of bushings 62 or 62', according to this invention is incorporated in the raised bore drilling rig. As noted above, the improved drill string may be of constant non-round transverse cross-section uniformly along the entirety of its length; in such a case the torque transmitting, axial motion accommodating bushing in the rotary table may be simpler than either of bushings 62 or 62' which constitute the preferred torque transmitting means in a raise boring rig of this invention. For the reasons set forth above, however, the periodically cylindrical but otherwise essentially entirely non-round drill string, and the more complicted torque transmitting means (which provide vertical motion of the drive rollers and retractability of the drive rollers toward and away from the drill string axis) is preferred. Drill string 44 and the torque transmitting mechanisms 62 and 62' are preferred over the more simple alternate arrangements mentioned above because their overall operational procedure is believed simpler and safer in raise bore drilling.

As noted above, the drill string can be provided as an entirely non-round drill string, preferably of regular polygonal cross-sectional configuration at all locations along its length, in which the drill string is periodically of increased cross-sectional area as at connections between individual joints in the drill string. For example, such a drill string can be composed of joints having a square or hexagonal cross-sectional outline at all points along its length, but each joint can be increased in outline area at its opposite ends along and adjacent to male and female interjoint connection moieties, the increase in cross-sectional area at the ends of the joint being provided to assure adequate strength in the drill string at the interjoint connections.

A variable area, constant shape non-round drill string has the same disadvantage as the constant outline and shape non-round drill string in terms of proper angular alignment of the adjacent joints at an interjoint connection, which disadvantage can require the use of shims in an interjoint connection to assure proper angular alignment of the adjacent joints. On the other hand, torque can be applied by a suitable drive bushing to a variable area, constant shape non-round drill string at all locations along its length, even at the locations where adjacent joints are connected to each other. A drive bushing for such a drill string need not enable the torque transmitting string-contacting members of the bushing, such as drive rollers 88 and 89 of drive bushing 62, to move in the bushing parallel to the length of the drill string. A drive bushing for such a drill string, to enable torque to be applied to the string at any point therealong, can be made expansible to enable the string portions of increased area to pass through the bushing while maintaining torque transmitting engagement of the string-contacting members with the string.

For example, a drive bushing for a variable area, constant shape non-round drill string can include sensing means for sensing changes in the transverse dimensions of the string as the string is moved axially through the bushing, and control means responsive to the sensing means for controllably moving the string-contacting members toward and away from the drill string axis sufficiently to maintain effective torque transmitting contact of the contacting members with the drill string as a location of increased area in the string approaches, moves past and leaves the location of the contacting members in the bushing. The sensing means can be a finger-type sensor which engages the drill string in the bushing for sensing the transverse dimension of the drill string at the location of the contacting members in the drill string, or it can be a force sensitive sensor connected to one or more of the contacting members for sensing the load thereon radially of the drill string. The control means for moving the contacting members can be a motor connected to the contacting members directly or by a suitable linkage for driving the contacting members toward and away from the drill string. For example, the control means could be provided in a bushing similar to bushing 62 in which worm shafts 99 are interconnected in the manner of gears 107 and chain 108 and a reversible motor, operated in response to the output of the sensing means, is connected to one of the worm shafts.

Workers skilled in the art to which this invention pertains will appreciate that modifications, alterations, or variations in the structures or procedures described above may be made or practiced without departing from the scope of this invention. For example, an improved drill string can be made square in cross-section rather than hexagonal. It is not essential that the torque transmitting mechanism used with the drill string incorporate rollers, such as rollers 88 and 89. Thus a pair of opposed reciprocal blocks, configured to define a hexagonal bore when the blocks are mated, may be used in place of rollers 88 and 89 on the top plate of bushings 62 and 62' to define a torque transmitting and axial-motion-accommodating female spline moiety in boring rig 10; where the drill string is periodically cylindrical in configuration rather than entirely non-round, retractability of the blocks on suitable guideways on the top plate render the bushing effectively expansible to permit the enlarged diameter cylindrical portion of the drill string to pass through the spline defined by the blocks in their engaged positions with the drill string. In view of the alterations, modifications or variations which may be made in the illustrated procedures and apparatus, the following claims are not to be considered as limiting the scope of this invention.

What is claimed is:

1. In a method of raise bore drilling in which a drill string extends in a pilot hole between a raise bore drilling bit at the lower end of the pilot hole and a drill string drive means above and adjacent the upper end of the pilot hole, the drill string drive means including means operable for applying torque and axial tension to the drill string while affording axial motion of the drill string, the improvement comprising using a drill string which is non-round, except at spaced periodic locations along the elongate extent of the drill string, for transmitting torque and axial tension from the drive means to the bit.

2. In a raise bore drilling method according to claim 1 in which the drive means is operable for rotating the drill string about its axis to apply torque to the raise bore drilling bit via the drill string and for applying an axial tensile load to the drill string which is composed of a plurality of non-round individual drill string lengths, and in which the method includes the steps of operating the drive means to rotate the drill string and to raise the drill string until a connection in the string between individual lengths thereof is accessible at the drive means, locking the drive means from rotation of the drill string about its axis while maintaining engagement of the drive means below the connection with the non-round drill string to prevent rotation of the drill string below the connection, and disconnecting from the upper end of the non-round drill string at least one individual length thereof, the improvement which comprises the further steps of providing holding apparatus in the drive means, separate from the portions of the drive means operable for applying torque and an axial tensile load to the drill string in the drive means, and operating the holding apparatus before performing the disconnecting step.

3. In a method of raise bore drilling according to claim 1 wherein at least some of the individual drill string lengths have a circularly cylindrical portion adjacent one end of the length and are of regular polygonal cross-section along the remainder major portion of the length thereof, the diameter of the cylindrical portion being at least as great as a diagonal of the polygonal cross-section, the drive means comprises rotary means drivable about the axis of the drill string and matable with the non-round exterior of the drill string for application of torque to the drill string while accommodating axial movement of the drill string, the drill string is composed of a plurality of threadably connected individual non-round drill string lengths, the rotary means includes a plurality of rollers engageable with the polygonal portion of a length for applying torque thereto and for accommodating axial motion thereof, the rollers being mounted to be driven about the drill string axis and for limited movement along but not about the axis, and the method includes the step of retracting the rollers away from the drill string to enable a cylindrical portion of a drill string length connection to pass through the rotary means.

4. In a method of raise bore drilling according to claim 1 wherein at least some of the individual drill string lengths have an externally round connection component at the one end thereof and are of regular polygonal cross-section along the remainder major portion of its length, the diameter of the round connection component being at least as great as a diagonal of the polygonal cross-section, the drive means comprises rotary means drivable about the axis of the drill string and matable with the non-round exterior of the drill string for application of torque to the drill string while accommodating axial movement of the drill string, and the method includes the step of expanding the rotary means to enable a round connection component to pass through the rotary means.

5. In a method of raise bore drilling according to claim 4, the further step of expanding the rotary means in the drive means.

6. In a method of raise bore drilling according to claim 5, the further step of expanding the rotary means without substantial alteration of the torque applying geometry of the rotary means.

7. In a method of raise bore drilling in which a drill string composed of individual drill string lengths extends in a pilot hole between a raise bore drilling bit at the lower end of the pilot hole and a drill string drive means above and adjacent the upper end of the pilot hole, and the drill string drive means including means operable for applying torque to the drill string while affording axial motion of the drill string therepast, the drill string being provided for transmitting torque and axial tension from the drive means to the raise bore drilling bit, the improvement comprising the steps of using a drill string which is of constant non-round cross-sectional configuration except adjacent locations at which individual drill string lengths are connected and at which locations the drill string is of increased cross-sectional configuration, providing as a component of the drive means a rotary means drivable about the axis of the drill string and matable with the non-round exterior of the drill string for application of torque to the drill string while accommodating axial movement of the drill string, and expanding the rotary means to enable one of said locations of the drill string to pass through the rotary means.

8. A method of drilling a raise through a subterranean formation from an initiation point in the subterranean formation to a working area which comprises the steps of:

a. forming a pilot bore hole through the formation between the initiation point and working area along the axis of the intended raise, b. extending a drill string through the pilot hole between the initiation point and the working area, the drill string being comprised of a plurality of pipe lengths each having a non-round cross-sectional configuration along a major portion of the elongate extent of the pipe length and a circular cross-sectional configuration along a remainder minor portion of its elongate extent at one end thereof, thereby to impart to each pipe length a cylindrical portion at the one end thereof, the diameter of the cylindrical portion of each pipe length being at least as great as the greatest transverse dimension of the non-round portion of the pipe length, the several pipe lengths being releasably interconnected in the drill string with the cylindrical portion of each length being diposed toward the working area from the non-round portion thereof, c. at the initiation point, connecting a raise bore drilling bit to the end of the drill string extending through the pilot hole to the initiation point, d. extablishing a selected amount of axial tension in the drill string, e. at the working area, applying torque to the drill string by mating with the non-round portion of the drill string a torque transmitting bushing which includes (1) engaging means for engaging the non-round portion of a pipe length in torque applying relationship while at an axial base position thereof in the bushing and for accommodating the axial movement of an engaged pipe length therethrough while at the base position and (2) means connected to the engaging means for accommodating movement, with the engaging means remaining in said torque applying relationship, of the engaging means from the base position thereof along the axis for a distance at least as great as the length of a pipe length cylindrical portion on contact of the cylindrical portion of an adjacent pipe length in the drill string with the engaging means, f. rotating the drill string for drilling the raise by rotating the bushing means about the axis of the drill string.

9. The method of claim 8 which comprises the additional steps of a. terminating rotation of the drill string when the engaging means has contacted the cylindrical portion of the pipe length adjacent the pipe length engaged by the bushing and has moved a distance along the axis of the drill string at least as great as the length of the cylindrical portion, b. securing the bushing from rotation thereof about the axis, c. securing the drill string from movement axially through the bushing, and d. removing from the drill string any pipe lengths which extend entirely on the working area side of the bushing.

10. The method of claim 8 wherein each pipe length has a female connecting moiety at the end thereof at which the pipe length defines the cylindrical portion thereof, each pipe length having a male connecting moiety at its opposite end.

11. The method of claim 8 wherein the axial extent of each pipe length cylindrical portion is less than about twice the diameter of the cylindrical portion.

12. The method of claim 11 wherein the axial extent of each pipe length cylindrical portion is about as great as the diameter of the cylindrical portion.

13. A raise bore drilling rig for use with a drill string composed of a plurality of drill pipe lengths each having male and female torque and tension transmitting connection moieties at its opposite ends, having a non-round external cross-sectional configuration along at least a portion of the elongate extent thereof and being of increased cross-sectional area at the female end thereof, the rig comprising a rotary table having a drivable annular member rotatable about a vertical axis and through which the drill string can be raised along the axis during raise bore drilling, and torque transmitting means essentially permanently coupled to the annular member in use for rotation therewith and configured to mate with the drill string for transmitting torque from the annular member to the drill string and for accommodating axial movement of the drill string, including upward movement of a female connection moiety in the drill string effectively through a base position of the torque transmitting means relative to the annular member along the axis while maintaining torque transmitting engagement of the torque transmitting means with the drill string.

14. A raise bore drilling rig for use with a drill string composed of a plurality of individual drill pipe lengths of non-round transverse external cross-section, the rig comprising a rotary table having a drivable annular member rotatable about a central vertical axis and through which the drill string can be raised during raise boring, and torque transmitting means essentially permanently mounted to the annular member in use for rotation therewith and including engaging means configured to mate with the non-round portion of the drill string for transmitting torque from the member to the drill string while accommodating axial movement of the drill string including movement of a connection in the drill string between adjacent pipe lengths effectively through a base position of the engaging means vertically relative to the annular member while maintaining torque transmitting engagement of the engaging means with the drill string.

15. A raise bore drilling rig according to claim 14 wherein the engaging means includes roller means disposed about the central axis and configured to mate with the non-round portion of the drill string for transmitting torque to the drill string while accommodating said axial movement thereof through the engaging means, and means mounting the roller means for movement toward and away from the central axis.

16. A raise bore drilling rig according to claim 14 including selectively operable holding means releasably engageable with a drill string in the torque transmitting means for holding the drill string from downward movement relative to the rotary table.

17. A raise bore drilling rig according to claim 16 wherein each of the pipe lengths has an upper end and defines, in the exterior thereof adjacent to and a selected distance from the upper end thereof, shoulder means opening toward the other end thereof, and the holding means is engageable with the shoulder means.

18. A raise bore drilling rig according to claim 16 wherein the holding means are provided separately from the torque transmitting means.

19. A raise bore drilling rig according to claim 16 wherein the holding means is engageable with a drill string at a location on the drill string below the torque transmitting means.

20. A raise bore drilling rig for use with a drill string composed of a plurality of individual pipe lengths each having male and female torque and axial load transmitting connection moieties at its opposite ends, each pipe length having a non-round cross-sectional configuration along the extent thereof from the male end thereof to a circularly cylindrical end portion at the female end thereof, the diameter of the cylindrical portion being at least as great as the greatest transverse dimension of the non-round portion of the pipe length, the rig comprising a. a rotary table having a drivable annular member rotatable about an axis and through which the drill string can be raised along the axis during raise bore drilling, b. torque transmitting means essentially permanently connected in use to the annular member for rotation therewith and configured to mate with the non-round portion of the drill string for transmitting torque from the annular member to the drill string and for accommodating axial movement of the drill string, including movement of a drill string cylindrical portion through a base position of the torque transmitting means relative to the annular member, while maintaining torque transmitting engagement with the drill string.

21. A raise bore drilling rig according to claim 20 wherein the holding means is engageable with a drill string at a location on the drill string below the torque transmitting means.

22. A raise bore drilling rig according to claim 20 wherein the torque transmitting means includes selectively operable means operable for effectively expanding the torque transmitting means to enable passage of a cylindrical portion of a pipe length axially therethrough.

23. A raise bore drilling rig according to claim 20 including selectively operable holding means mounted to the annular member and releasably engageable with a drill string disposed along the axis through the annular member for holding the drill string from downward movement relative to the annular member.

24. A raise bore drilling rig according to claim 23 wherein each pipe length, at the intersection of the cylindrical portion thereof with the non-round portion thereof, defines a shoulder facing along the pipe length toward the male end thereof, and the holding means is engageable with the shoulder.

25. A raise bore drilling rig according to claim 20 wherein the torque transmitting means includes roller means diposed about the axis for rotation with the annular member and configured to mate with the non-round portion of the drill string for transmitting torque to the drill string while accommodating axial movement thereof, and mounting means mounting the roller means for movement thereof from the base position thereof parallel to the axis by an amount related to the length of a drill string cylindrical portion along the drill string.

26. A raise bore drilling rig according to claim 25 wherein the non-round cross-sectional configuration of the drill string is that of a regular polygon and the roller means comprises a plurality of rollers profiled to mate with corresponding portions of the polygonal cross-section of the drill string.

27. A raise bore drilling rig according to claim 25 wherein the mounting means mounting the roller means includes means mounting the individual rollers for movement between a torque transmitting engaged position inwardly toward the axis and a retracted position outwardly of the engaged position thereof sufficiently for passage of a drill string cylindrical portion therepast.

28. A raise bore drilling rig according to claim 25 including selectively operable means coupled to the roller means and operable for moving the roller means parallel to the axis from the base position thereof by said amount.

29. A raise bore drilling rig according to claim 20 wherein the holding means are provided separately from the torque transmitting means.

30. A raise bore drilling rig according to claim 29 wherein the non-round cross-sectional configuration of the drill string is that of a regular polygon and the roller means comprises a plurality of rollers profiled to mate with corresponding portions of the polygonal cross-section of the drill string.

31. A raise bore drilling rig according to claim 29 wherein the mounting means mounting the roller means includes means mounting the individual rollers for movement between a torque transmitting engaged position inwardly toward the axis and a retracted position outwardly of the engaged position thereof sufficiently for passage of a drill string cylindrical portion therepast.

32. A raise bore drilling rig according to claim 29 including selectively operable means coupled to the roller means and operable for moving the roller means parallel to the axis from the base position thereof by said amount.

33. A raise bore drilling rig for use with a drill string composed of a plurality of individual pipe lengths of uniform regular polygonal transverse cross-sectional configuration except a portion at the upper end of each pipe length where the pipe length is of circularly cylindrical configuration for a selected distance along the pipe length which is related to the axial extent of a connection in the drill string between adjacent pipe lengths, the diameter of the cylindrical portion being at least as great as substantially the greatest diagonal of the polygonal cross-section, the rig comprising a rotary table having an annular member rotatable about a vertical axis corresponding to the rotational axis of the drill string, torque transmitting bushing means having an opening through which the drill string can pass and mounted to the annular member for rotation therewith with the opening thereof centered on the axis, the bushing means including a plurality of rollers configured to mate with the polygonal cross-section of the drill string for transmitting torque to the drill string from the annular member and for accommodating axial motion of the drill string through the bushing means, and means mounting the rollers for motion thereof from a base position of the rollers relative to the annular member vertically along but not angularly about the axis relative to the annular member by an amount related to the selected distance and for motion of the rollers outwardly from the axis between an inward position in which the rollers are matable in torque transmitting relation to the polygonal cross-sectional configuration of the drill string and an outward position, the rollers in their outward position being spaced from the inward position thereof sufficiently to provide clearance for passage of a connection in the drill string through the bushing means.

34. A raise bore drilling rig according to claim 33 wherein the polygonal cross-sectional configuration of the drill string is an equilateral hexagon, and the rollers comprise a pair of cylindrical rollers and a pair of biconical rollers.

35. A raise bore drilling rig according to claim 33 including means selectively operable for moving the rollers simultaneously between their inward and outward positions.

36. A raise bore drilling rig according to claim 33 including means selectively operable for moving the rollers concurrently between their inward and outward positions.

37. A raise bore drilling rig according to claim 33 wherein each pipe length defines shoulder means at the lower end of the cylindrical portion thereof, the shoulder means opening toward the lower end of the pipe length, and holding means in the bushing means selectively engageable with the shoulder means for holding the drill string from downward motion along the axis.

38. A raise bore drilling rig according to claim 37 wherein the holding means is configured to mate with the polygonal cross-sectional configuration of the drill string for securing the drill string from rotation about the axis relative to the bushing means.

39. A method of operating a raise bore drilling rig as defined in claim 38 for drilling a raise using the polygonal cross-sectionally configured drill string, the method comprising the steps of 1. connecting a swivel to the upper end of the drill string which extends through a raise pilot hole aligned with the axis and through the rotary table and which is connected at its lower end to a raise bore drilling bit,
2. disposing the rollers in the inward position thereof to mate the rollers in torque transmitting relation with the polygonal portion of the drill string pipe length extending through the bushing means, and
   a. rotating the annular member to apply to the drill string via the rollers sufficient torque to operate the bit, and
   b. raising the drill string via the swivel along said axis through the bushing means as the bit operates to form the raise while maintaining in the drill string a selected level of axial tension,
3. continuing the procedures according to step (2) until the cylindrical portion of the drill string immediately below the pipe length extending through the bushing means engages and raises the rollers said amount in the bushing means, 4. ceasing rotation of the annular member while holding the axial position of the drill string to maintain the selected tension level therein,
5. disposing the rollers in the outward position thereof for movement of the rollers downwardly in the bushing means to the base position thereof,
6. operating the holding means to mate with the polygonal cross-sectional configuration of the drill string below the drill string cylindrical portion immediately below the pipe length originally extending through the bushing means, thereby to secure the bushing means from rotation relative to the drill string,
7. gradually lowering the drill string to release torque and tension built up therein and then lowering the drill string in the bushing means until the shoulder means defined by the drill string cylindrical portion at the bushing means contacts the holding means for support of the drill string in the rotary table,
8. locking the annular member from rotation in the rotary table about said axis,
9. disconnecting the pipe length originally extending through the bushing means from the drill string and from the swivel and connecting the swivel to the drill string supported in the bushing means,
10. raising the drill string via the swivel through the bushing means to dispose the uppermost drill string cylindrical portion above the rollers,
11. disposing the rollers in the inward position thereof to mate the rollers in torque transmitting relation with the drill string polygonal cross-sectional configuration below the uppermost drill string cylindrical portion,
12. operating the holding means to move the same out of engagement with the drill string,
13. unlocking the annular member for rotation of the same in the rotary table about the axis, and
14. resuming performance of the procedures according to steps (2) (*a*) and (2) (*b*).

40. A raise bore drilling rig according to claim 33 including drive means selectively operable for driving the rollers along the axis from the base position thereof by said amount.

41. A raise bore drilling rig according to claim 40 including means operable for disabling the drive means in such manner as to minimize any impediment thereby to motion of the rollers along the axis.

42. A raise bore drilling rig according to claim 41 wherein the drive means comprises pneumatic means.

43. A raise bore drilling rig according to claim 42 wherein the disabling means includes a valve operable to provide communication between atmosphere and the pneumatic means for flow of air into and out of the pneumatic means in response to movement of the rollers along the axis by forces independent of the pneumatic means.

44. A raise bore drilling rig according to claim 43 wherein the bushing means comprises a lower plate fixed to the annular member and an upper plate aligned with the lower plate and substantially parallel thereto, the upper plate having the rollers mounted thereon, and wherein the means mounting the rollers for motion along but not angularly about the axis comprises guide means cooperating between the upper and lower plates.

45. A raise bore drilling rig according to claim 44 wherein the pneumatic means comprises an inflatable bladder disposed between the upper and lower plates.

46. A raise bore drilling rig according to claim 45 including spacer means cooperating between the upper and lower plates for defining a lowermost position of the upper plate in which the upper plate is spaced above the lower plate an amount greater than the vertical extent of the bladder in its uninflated state.

47. A method of operating a raise bore drilling rig as defined in claim 41 for drilling a hole downwardly using the polygonal cross-sectionally configured drill string, the method comprising the steps of 1. disposing the rollers in the inward position thereof to mate the rollers in torque transmitting relation with the polygonal portion of the drill string pipe length extending through the bushing means, and
   a. rotating the annular member to apply to the drill string via the rollers sufficient torque to operate a drill bit connected to the lower end of the drill string, and
   b. lowering the drill string along the axis through the bushing means as the drill bit operates to cut into a formation being drilled,
2. continuing the procedure according to step (1) until the cylindrical portion of the pipe length extending through the bushing means is lowered substantially into contact with the rollers,
3. ceasing rotation of the annular member,
4. connecting to the drill string an additional pipe length to extend the total length of the drill string,
5. disposing the rollers in the outward position thereof,
6. raising the rollers said amount along the drill string axis by operating the drive means,
7. disposing the rollers in the inward position thereof to mate the rollers in torque transmitting engagement with the polygonal cross-section portion of the additional pipe length above the drill string cylindrical portion passed by the rollers during performance of the procedure according to step (6),
8. disabling the drive means, and
9. repeating steps (1) (*a*), (1) (*b*), and (2), during the initial phases of which the rollers can move downward with the drill string cylindrical portion immediately therebelow and return to the base portion thereof.

48. The method according to claim 47 wherein the step of connecting to the drill string an additional pipe length includes the further steps of 1. securing the annular member from rotation about the axis, and
2. using the bushing means to hold the drill string from rotation about the axis.

49. A raise bore drilling rig for use with a drill string composed of a plurality of individual pipe lengths of uniform regular polygonal transverse cross-sectional configuration except a portion at the upper end of each pipe length where the pipe length is of circularly cylindrical configuration for a selected distance along the length related to the axial extent of a connection in the drill string between adjacent pipe lengths, the diameter of the cylindrical portion being at least substantially as great as the greatest diagonal of the polygonal cross-section, the rig comprising a rotary table having an annular member rotatable about a vertical axis corresponding to the rotational axis of the drill string, a derrick including a crown block substantially vertically positionable above the rotary table with the crown block disposed in alignment with said axis, a swivel connectible to the drill string via a cylindrical end of a drill string pipe length, a drawworks including a line for suspending the swivel in the drawworks from the crown block for movement of the swivel along said axis in response to operation of the drawworks, power source means for operating the rotary table to rotate the annular member about said axis and for operating the drawworks to raise and lower the swivel and to create axial tension in the drill string when the drill string is suspended from the swivel and extends along the axis through the annular member and through a raise pilot hole below the rotary table to a raise bit connected to the lower end of the drill string, torque transmitting bushing means having an opening through which the drill string can pass and mounted to the rotary table annular member for rotation therewith with the bushing means opening centered on the axis, the bushing means including a plurality of rollers configured to mate with the polygonal cross-section of the drill string for transmitting torque to the drill string from the annular member and for accommodating axial motion of the drill string through the bushing means, means mounting the rollers for motion thereof vertically along but not angularly about the axis relative to the annular member, from a base position of the rollers relative to the annular member, by an amount related to the selected distance and for motion of the rollers outwardly from the axis between an inward position in which the rollers are matable in torque transmitting relation to the polygonal cross-sectional configuration of the drill string and an outward position, the rollers in their outward position being spaced from the inward position thereof sufficiently to provide clearance for passage of a connection in the drill string through the bushing means, means selectively operable for moving the rollers concurrently between their inward and outward positions, and holding means carried by the rotary table selectively engageable with the lower end of the cylindrical portion of a drill string pipe length for holding the drill string from downward motion along the axis.

50. A raise bore drilling rig according to claim 49 wherein the power source means comprises separate power sources for the rotary table and for the drawworks.

51. A raise bore drilling rig according to claim 49 wherein the derrick and the drawworks are mounted on a chassis separate from the rotary table.

52. A raise bore drilling rig according to claim 51 including a frame for the rotary table, and wherein the power source means comprises a power source for the rotary table mounted to the frame and a power source for the drawworks mounted to the chassis.

53. In a raise bore drilling rig for use with a drill string extending from a raise bore drilling bit into the rig, the drill string comprising a plurality of pipe lengths each having a non-round cross-sectional configuration along a major portion of the elongate extent of the pipe length and a circular cross-sectional configuration along a remainder portion of its elongate extent at the end thereof, whereby each pipe length has a cylindrical portion at one end thereof, the diameter of the cylindrical portion of each pipe length being at least substantially as great as the greatest transverse dimension of the non-round portion of the pipe length, the several pipe lengths being releasably interconnected in the drill string with the cylindrical portions thereof being the most remote end of each pipe length from the bit, the rig also comprising means connectible to the drill string for applying axial tension to the drill string along the longitudinal axis of the drill string, and a rotary table having a rotatable member through which the drill string can be moved along the longitudinal axis of the drill string, the improvement comprising a torque transmitting bushing essentially permanently connected in use to the rotatable member and having engaging means for engaging the non-round portion of the drill string in a torque applying relationship while at a base position thereof axially in the bushing and for accommodating axial movement of the non-round portion of the drill string therethrough while at the base position, the bushing also having means connected to the engaging means for accommodating movement of the engaging means from the base position along the longitudinal axis of the drill string, while the engaging means is in a torque applying relationship to the drill string, for a distance at least as great as the extent of a pipe length cylindrical portion axially of the pipe length, on contact of the cylindrical portion of an adjacent pipe length in the drill string with the engaging means.

54. A torque transmitting bushing for cooperation with a component of a drill string, which component is of non-round transverse cross-sectional configuration, the bushing comprising a. a plurality of cooperating drive elements disposed about an axis of the bushing and configured to mate substantially circumferentially with the non-round configuration of the drill string component for application of torque to the component, b. carrier means carrying the drive elements and connectible to the rotary collar of a rotary table, for rotation therewith, to dispose the bushing axis in alignment with the axis of rotation of the rotary collar, c. means mounting the drive elements to the carrier means for movement along predetermined paths radially of the bushing axis, but not angularly about the bushing axis, into and out of an inward position of the drive elements in which the elements are disposed to mate with the non-round configuration of the drill string component, and d. selectively operable means operable for moving the drive elements substantially concurrently along their predetermined paths.

55. A bushing according to claim 54 wherein the selectively operable means is operable for moving the drive elements concurrently equal amounts along their respective predetermined paths.

56. A bushing according to claim 54 wherein the drive elements are rollers mounted to the carrier means for rotation about axes perpendicular to and spaced from the bushing axis.

57. A bushing according to claim 56 wherein the drill string component non-round cross-sectional configuration is that of a regular hexagon, and there are four rollers cooperatively profiled for mating with all six sides of the hexagon.

58. A torque transmitting bushing for cooperation with a component of a drill string, which component is of non-round transverse cross-sectional configuration, the bushing comprising a. a plurality of cooperating drive elements disposed about an axis of the bushing and configured to mate substantially circumferentially with the non-round configuration of the drill string component for application of torque to the component, b. carrier means carrying the drive elements and connectible to the rotary collar of a rotary table, for rotation therewith, to dispose the bushing axis in alignment with the axis of rotation of the rotary collar, c. means mounting the drive elements to the carrier means for movement along predetermined paths radially of the bushing axis, but not angularly about the bushing axis, into and out of an inward position of the drive elements in which the elements are disposed to mate with the non-round configuration of the drill string component, d. selectively operable means operable for moving the drive elements along their predetermined paths, and e. the carrier means includes means mounting the drive elements for motion as a group parallel to the bushing axis, but not angularly about the bushing axis within the bushing, between a base position and a displaced position.

59. A raise bore drilling rig according to claim 58 including means operable for disabling the drive means in such manner as to minimize any substantial impediment thereby to motion of the rollers along the axis.

60. A bushing according to claim 58 wherein the selectively operable means is operable for moving the drive elements along their predetermined paths independently of the position of the drive elements along the axis.

61. A bushing according to claim 58 including drive means for moving the drive elements from their base position to their displaced position.

62. A bushing according to claim 61 wherein the drive means includes means operable for rendering the drive means passive so that the drive elements can be moved between their displaced and base positions by forces independent of the drive means without substantial restraint by the drive means.

63. A bushing according to claim 62 wherein the bushing includes a lower member, the carrier means comprises an upper member carrying the drive elements and mounted for movement between base and displaced positions thereof relative to the lower member parallel to the bushing axis, and the drive means is coupled between the upper and lower members.

64. A bushing according to claim 63 wherein the drive means comprises a pneumatic inflatable bladder engaged between the upper and lower members for moving the upper member along the bushing axis upon inflation thereof.

65. A bushing according to claim 64 wherein the members have openings therethrough along the bushing axis, and the bladder is annular and is disposed about the bushing axis outwardly of said openings.

66. A bushing according to claim 65 including closable means for selectively communicating the interior of the bladder to atmosphere.

67. A torque transmitting bushing for cooperation with a component of a drill string, which component is of non-round transverse cross-sectional configuration, the bushing comprising a. a plurality of cooperating drive elements disposed about an axis of the bushing and configured to mate substantially circumferentially with the non-round configuration of the drill string component for application of torque to the component, b. carrier means carrying the drive elements and connectible to the rotary collar of a rotary table, for rotation therewith, to dispose the bushing axis in alignment with the axis of rotation of the rotary collar, c. means mounting the drive elements to the carrier means for movement along predetermined paths radially of the bushing axis, but not angularly about the bushing axis, into and out of an inward position of the drive elements in which the elements are disposed to mate with the non-round configuration of the drill string component, d. selectively operable means operable for moving the drive elements along their predetermined paths, and e. holding means in the bushing movable into and out of an operated position in which the holding means is engageable with a drill string in the bushing for holding the drill string from moving downwardly along the bushing axis relative to the bushing.

68. A bushing according to claim 67 wherein the holding means is configured to register with the non-round configuration of the drill string component for holding the drill string from rotation about the bushing axis relative to the bushing independently of any similar rotation preventing operation of the drive elements.

69. A raise bore drilling rig for use with a drill string composed of a plurality of drill pipe lengths each having male and female torque and tension transmitting connection moieties at its opposite ends, having a non-round external cross-sectional configuration along at least a portion of the elongate extent thereof and being of increased cross-sectional area at the female end thereof, the rig comprising a rotary table having a drivable annular member rotatable about a vertical axis and through which the drill string can be raised along the axis during raise bore drilling, and torque transmitting means connected to the annular member for rotation therewith and configured to mate with the drill string for transmitting torque from the annular member to the drill string and for accommodating axial movement of the drill string while maintaining torque transmitting engagement of the torque transmitting means with the drill string, the torque transmitting means being expansible in place as connected to the annular member for accommodating movement of a female connection moiety in the drill string effectively through a base position of the torque transmitting means relative to the annular member along the axis and upwardly past the torque transmitting means.

70. A raise bore drilling rig for use with a drill string composed of a plurality of individual drill pipe lengths of non-round transverse external cross-section, the rig comprising a rotary table having a drivable annular member rotatable about a central vertical axis and through which the drill string can be raised during raise boring, torque transmitting means mounted to the annular member for rotation therewith and including engaging means configured to mate with the non-round portion of the drill string for transmitting torque from the member to the drill string while accommodating axial movement of the drill string including movement of a connection in the drill string between adjacent pipe lengths effectively through a base position of the engaging means vertically relative to the annular member while maintaining torque transmitting engagement of the engaging means with the drill string, the engaging means including roller means disposed about the central axis and configured to mate with the non-round portion of the drill string for transmitting torque to the drill string while accommodating said axial movement thereof through the engaging means, and means mounting the roller means for movement toward and away from the central axis.

71. A raise bore drilling rig for use with a drill string composed of a plurality of individual drill pipe lengths of non-round transverse external cross-section, the rig comprising a rotary table having a drivable annular member rotatable about a central vertical axis and through which the drill string can be raised during raise boring, torque transmitting means mounted to the annular member for rotation therewith and including engaging means configured to mate with the non-round portion of the drill string for transmitting torque from the member to the drill string while accommodating axial movement of the drill string including movement of a connection in the drill string between adjacent pipe lengths effectively through a base position of the engaging means vertically relative to the annular member while maintaining torque transmitting engagement of the engaging means with the drill string, and selectively operable holding means releasably engageable with a drill string in the torque transmitting means for holding the drill string from downward movement relative to the rotary table, the holding means being mounted to the annular member and being provided separately from the torque transmitting means.

72. A raise bore drilling rig according to claim 71 wherein the holding means is engageable with the drill string at a location on the drill string below the torque transmitting means.

73. A raise bore drilling rig for use with a drill string composed of a plurality of individual pipe lengths each having male and female torque and axial load transmitting connection moieties at its opposite ends, each pipe length having a non-round cross-sectional configuration along the extent thereof from the male end thereof to a circularly cylindrical end portion at the female end thereof, the diameter of the cylindrical portion being at least as great as the greatest transverse dimension of the non-round portion of the pipe lengths, the rig comprising a. a rotary table having a drivable annular member rotatable about an axis and through which the drill string can be raised along the axis during raise bore drilling, b. torque transmitting means connected to the annular member for rotation therewith and configured to mate with the non-round portion of the drill string for transmitting torque from the annular member to the drill string and for accommodating axial movement of the drill string, including movement of a drill string cylindrical portion through a base position of the torque transmitting means relative to the annular member, while maintaining torque transmitting engagement with the drill string, c. the torque transmitting means including roller means disposed about the axis for rotation with the annular member and configured to mate with the non-round portion of the drill string for transmitting torque to the drill string while accommodating axial movement thereof, and d. mounting means mounting the roller means for movement thereof from the base position thereof parallel to the axis by an amount related to the length of a drill string cylindrical portion along the drill string.

74. A raise bore drilling rig for use with a drill string composed of a plurality of individual pipe lengths each having male and female torque and axial load transmitting connection moieties at its opposite ends, each pipe length having a non-round cross-sectional configuration along the extent thereof from the male end thereof to a circularly cylindrical end portion at the female end thereof, the diameter of the cylindrical portion being at least as great as the greatest transverse dimension of the non-round portion of the pipe length, the rig comprising a. a rotary table having a drivable annular member rotatable about an axis and through which the drill string can be raised along the axis during raise bore drilling, b. torque transmitting means connected to the annular member for rotation therewith and configured to mate with the non-round portion of the drill string for transmitting torque from the annular member to the drill string and for accommodating axial movement of the drill string, including movement of a drill string cylindrical portion through a base position of the torque transmitting means relative to the annular member, while maintaining torque transmitting engagement with the drill string, and c. selectively operable holding means mounted to the annular member effectively separately from the torque transmitting means and releasably engageable with a drill string disposed along the axis through the annular member for holding the drill string from downward movement relative to the annular member.

75. A raise bore drilling rig for use with a drill string composed of a plurality of individual pipe lengths each having male and female torque and axial load transmitting connection moieties at its opposite ends, each pipe length having a non-round cross-sectional configuration along the extent thereof from the male end thereof to a circularly cylindrical end portion at the female end thereof, the diameter of the cylindrical portion being at least as great as the greatest transverse dimension of the non-round portion of the pipe length, the rig comprising a. a rotary table having a drivable annular member rotatable about an axis and through which the drill string can be raised along the axis during raise bore drilling, b. torque transmitting means connected to the annular member for rotation therewith and configured to mate with the non-round portion of the drill string for transmitting torque from the annular member to the drill string and for accommodating axial movement of the drill string, including movement of a drill string cylindrical portion through a base position of the torque transmitting means relative to the annular member, while maintaining torque transmitting engagement with the drill string, c. the torque transmitting means including selectively operable means operable for effectively expanding the torque transmitting means to enable passage of a cylindrical portion of a pipe length axially therethrough.

76. A raise bore drilling rig according to claim 75 wherein the selectively operable means is arranged for expansion thereof in place as connected to the annular member.

77. A raise bore drilling rig for use with a drill string composed of a plurality of individual pipe lengths of uniform regular polygonal transverse cross-sectional configuration except a portion at the upper end of each pipe length where the pipe length is of increased cross-sectional area for a selected distance along the length related to the axial extent of a connection in the drill string between adjacent pipe lengths, the rig comprising a rotary table having an annular member rotatable about a vertical axis corresponding to the rotational axis of the drill string, a plurality of rollers configured to mate with the polygonal cross-section of the drill string for transmitting torque to the drill string from the annular member and for accommodating axial motion of the drill string therepast, means mounting the rollers to the annular member for torque transmitting engagement of the rollers with the drill string and for motion of the rollers vertically along but not angularly about the axis relative to the annular member, from a base position of the rollers relative to the annular member, by an amount related to the selected distance and for motion of the rollers outwardly from the axis, and drive means coupled to the rollers and selectively operable for driving the rollers along the axis from the base position thereof by said amount.

* * * * *

UNITED STATES PATENT AND TRADEMARK OFFICE

CERTIFICATE OF CORRECTION

PATENT NO. : 4,073,352

DATED : February 14, 1978

INVENTOR(S) : Gene E. Underwood

It is certified that error appears in the above-identified patent and that said Letters Patent are hereby corrected as shown below:

Column 1, line 8, after "novel" read -- raise --;
Column 1, line 37, for "scale" read -- shale --.
Column 2, line 57, for "remoed" read -- removed --.
Column 4, line 3, before "while" read -- string --;
Column 4, line 23, for "a" read -- an --;
Column 4, line 66, for "o" read -- of --;
for "tabl" read -- table --.
Column 6, line 22, for "Rach" read -- Rack --;
Column 6, line 32, for "described" read -- desired --.
Column 8, line 21, for "52" read -- 51 --.
Column 9, line 31, after "guiding" read -- the --.
Column 10, line 28, for "te" read -- the --.
Column 12, line 8, for "interesect" read -- intersect --;
Column 12, line 21, for "work" read -- worm --;
Column 12, lines 28, 29, delete "mate in torque transmitting relation with a removable crank"; (line repeated)
Column 12, line 30, for "work" read -- worm --;
Column 12, line 44, for "disconnected" read -- connected --.
Column 13, line 27, for "rolles" read -- rollers --;
Column 13, line 60, for "he" read -- the --.
Column 14, line 23, for "able" read -- table --.

UNITED STATES PATENT AND TRADEMARK OFFICE

CERTIFICATE OF CORRECTION

PATENT NO. : 4,073,352

DATED : February 14, 1978

INVENTOR(S) : Gene E. Underwood

It is certified that error appears in the above-identified patent and that said Letters Patent are hereby corrected as shown below:

Column 15, line 32, before "moiety" read -- coupling --;
Column 15, line 69, as a new line, insert -- joint for holding tools, such as holding tools 76, to engage --.
Column 16, line 56, for "raised" read -- raise --;
Column 16, line 67, after "vertical" read -- floating --.
Column 20, line 29, for "diposed" read -- disposed --;
Column 20, line 35, for "extablishing" read -- establishing --.
Column 26, line 45, for "portion" read -- position --.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*